US010022786B2

(12) United States Patent
Gill et al.

(10) Patent No.: US 10,022,786 B2
(45) Date of Patent: Jul. 17, 2018

(54) ULTRASONIC GRAIN REFINING

(71) Applicant: SOUTHWIRE COMPANY, Carrollton, GA (US)

(72) Inventors: Kevin Scott Gill, Carrollton, GA (US); Michael Caleb Powell, Dallas, GA (US); Victor Frederic Rundquist, Carrollton, GA (US); Venkata Kiran Manchiraju, Villa Rica, GA (US); Roland Earl Guffey, Cloverport, KY (US)

(73) Assignee: SOUTHWIRE COMPANY, Carrollton, GA (US)

( * ) Notice: Subject to any disclaimer, the term of this patent is extended or adjusted under 35 U.S.C. 154(b) by 0 days.

(21) Appl. No.: 15/627,045

(22) Filed: Jun. 19, 2017

(65) Prior Publication Data

US 2017/0282241 A1 Oct. 5, 2017

Related U.S. Application Data

(63) Continuation of application No. 15/337,645, filed as application No. PCT/US2016/050978 on Sep. 9, 2016.

(Continued)

(51) Int. Cl.
*B22D 11/00* (2006.01)
*B22D 11/12* (2006.01)

(Continued)

(52) U.S. Cl.
CPC ..... *B22D 11/12* (2013.01); *B22D 11/0611* (2013.01); *B22D 11/0651* (2013.01); *B22D 21/007* (2013.01); *B22D 27/20* (2013.01)

(58) Field of Classification Search
CPC ..... B22D 11/117

(Continued)

(56) References Cited

U.S. PATENT DOCUMENTS 1,318,740 A 10/1919 Fessenden
2,408,627 A 10/1946 Green (Continued)

FOREIGN PATENT DOCUMENTS

CN 101775518 7/2010
CN 101829777 9/2010

(Continued)

OTHER PUBLICATIONS

T.V. Atamenenko, et al. "Criteria of Grain Refinement Induced by Ultrasonic Melt Treatment of Aluminum Alloys Containing Zr and Ti," Metallurgical and Materials Transactions, vol. 41A, pp. 2056-2066, Aug. 2010.

(Continued)

*Primary Examiner* — Scott Kastler
(74) *Attorney, Agent, or Firm* — Oblon, McClelland, Maier & Neustadt, L.L.P.

(57) ABSTRACT

A molten metal processing device including an assembly mounted on the casting wheel, including at least one vibrational energy source which supplies vibrational energy to molten metal cast in the casting wheel while the molten metal in the casting wheel is cooled, and a support device holding the vibrational energy source. An associated method for forming a metal product which provides molten metal into a containment structure included as a part of a casting mill, cools the molten metal in the containment structure, and couples vibrational energy into the molten metal in the containment structure.

28 Claims, 15 Drawing Sheets

Related U.S. Application Data

(60) Provisional application No. 62/216,842, filed on Sep. 10, 2015, provisional application No. 62/267,507, filed on Dec. 15, 2015, provisional application No. 62/295,333, filed on Feb. 15, 2016, provisional application No. 62/372,592, filed on Aug. 9, 2016.

(51) Int. Cl.
*B22D 27/20* (2006.01)
*B22D 11/06* (2006.01)
*B22D 21/00* (2006.01)

(58) Field of Classification Search
USPC ..... 164/478
See application file for complete search history.

(56) References Cited

U.S. PATENT DOCUMENTS

| | | | | |
|---|---|---|---|---|
| 2,419,373 | A | 4/1947 | Schrumn | |
| 2,514,797 | A | 7/1950 | Robinson | |
| 2,615,271 | A | 10/1952 | Ulmer et al. | |
| 2,763,040 | A | 9/1956 | Korb | |
| 2,820,263 | A | 1/1958 | Fruengel | |
| 2,897,557 | A | 8/1959 | Ornitz | |
| 2,973,564 | A | 3/1961 | Dixon et al. | |
| 3,045,302 | A | 7/1962 | Patton | |
| 3,153,820 | A | 10/1964 | Criner | |
| 3,270,376 | A | 9/1966 | Thulmann | |
| 3,276,082 | A | 10/1966 | Thomas | |
| 3,395,560 | A | 8/1968 | Cofer et al. | |
| 3,461,942 | A | 8/1969 | Hoffman et al. | |
| 3,512,401 | A | 5/1970 | Thalmann | |
| 3,596,702 | A | 8/1971 | Ward et al. | |
| 3,678,988 | A | 7/1972 | Tien et al. | |
| 3,774,669 | A | 11/1973 | Lenaeus et al. | |
| 3,938,991 | A | 2/1976 | Sperry et al. | |
| 4,066,475 | A | 1/1978 | Chia | |
| 4,211,271 | A | 7/1980 | Ward | |
| 4,221,257 | A | 9/1980 | Narasimhan | |
| 4,498,518 | A | 12/1985 | Hasebe et al. | |
| 4,573,521 | A | 3/1986 | Artz | |
| 4,582,117 | A * | 4/1986 | Kushnick | B22D 11/0631 164/423 |
| 4,662,427 | A | 5/1987 | Larrecq et al. | |
| 4,733,717 | A | 3/1988 | Chia et al. | |
| 5,281,251 | A | 1/1994 | Kenny et al. | |
| 5,334,236 | A | 8/1994 | Sang et al. | |
| 5,355,935 | A | 10/1994 | Nogues | |
| 5,935,295 | A | 8/1999 | Megy | |
| 6,217,632 | B1 | 4/2001 | Megy | |
| 6,253,831 | B1 | 7/2001 | Genma et al. | |
| 6,336,495 | B1 | 1/2002 | McCullough et al. | |
| 6,397,925 | B1 | 6/2002 | Saito et al. | |
| 7,131,308 | B2 | 11/2006 | McCullough et al. | |
| 7,164,096 | B1 | 1/2007 | Gordon et al. | |
| 7,820,249 | B2 | 10/2010 | Nayar et al. | |
| 7,837,811 | B2 | 11/2010 | Motegi et al. | |
| 7,987,897 | B2 | 8/2011 | Anisimov et al. | |
| 8,236,231 | B2 | 8/2012 | Ferguson et al. | |
| 8,574,336 | B2 | 11/2013 | Rundquist | |
| 8,985,190 | B2 | 3/2015 | Jarry et al. | |
| 8,992,705 | B2 | 3/2015 | Furukawa et al. | |
| 9,222,151 | B2 | 12/2015 | Xing et al. | |
| 9,481,031 | B2 * | 11/2016 | Han | B22D 11/117 |
| 2004/0055735 | A1 | 3/2004 | Hong et al. | |
| 2004/0211540 | A1 | 10/2004 | Hong et al. | |
| 2011/0030914 | A1 | 2/2011 | Farina | |
| 2011/0303866 | A1 | 12/2011 | Li et al. | |
| 2012/0042751 | A1 * | 2/2012 | Rundquist | C22B 21/064 75/646 |
| 2012/0168040 | A1 | 7/2012 | Furukawa et al. | |
| 2012/0237395 | A1 | 9/2012 | Jarry | |
| 2013/0098208 | A1 | 4/2013 | Li et al. | |
| 2013/0156637 | A1 | 6/2013 | Park et al. | |
| 2015/0135901 | A1 | 5/2015 | Rundquist | |
| 2016/0228943 | A1 * | 8/2016 | Han | B22D 11/117 |
| 2016/0332219 | A1 | 11/2016 | Shu et al. | |
| 2016/0361764 | A1 | 12/2016 | Wang et al. | |
| 2017/0056971 | A1 | 3/2017 | Wang et al. | |

FOREIGN PATENT DOCUMENTS

| | | | |
|---|---|---|---|
| CN | 20172337 | | 1/2011 |
| CN | 101722288 | | 6/2011 |
| CN | 103949613 | A | 7/2014 |
| CN | 103273026 | B | 4/2015 |
| CN | 104492812 | A | 4/2015 |
| CN | 103498090 | B | 9/2015 |
| CN | 204639082 | U | 9/2015 |
| CN | 105087993 | A | 11/2015 |
| CN | 103643052 | B | 4/2016 |
| CN | 205254086 | U | 5/2016 |
| CN | 105728462 | A | 7/2016 |
| CN | 106244849 | A | 12/2016 |
| CN | 104451673 | B | 2/2017 |
| EP | 0583124 | | 9/1994 |
| EP | 0931607 | | 12/1997 |
| EP | 1250972 | | 10/2002 |
| FR | 1373768 | | 8/1963 |
| FR | 2323988 | | 2/1974 |
| GB | 1515933 | | 10/1975 |
| JP | 6186058 | | 5/1986 |
| JP | 62259644 | | 11/1987 |
| JP | 62270252 | | 11/1987 |
| JP | S63140744 | | 6/1988 |
| JP | S63160752 | | 7/1988 |
| JP | S63295061 | | 12/1988 |
| JP | 0381047 | | 4/1991 |
| JP | H062056 | | 1/1994 |
| JP | H0741876 | | 2/1995 |
| JP | H797681 | | 4/1995 |
| JP | H1192514 | | 4/1999 |
| JP | 2003326356 | | 11/2003 |
| JP | 3555485 | | 5/2004 |
| JP | 2006102807 | | 4/2006 |
| JP | 2008200692 | | 9/2008 |
| JP | 4551995 | | 7/2010 |
| JP | 4594336 | | 9/2010 |
| JP | 2010247179 | | 11/2010 |
| JP | 4984049 | | 5/2012 |
| JP | 5051636 | | 8/2012 |
| JP | 2013215756 | A | 10/2013 |
| JP | 5413815 | B2 | 2/2014 |
| JP | 5831344 | B2 | 11/2015 |
| JP | 2015208748 | A | 11/2015 |
| JP | 5861254 | B2 | 1/2016 |
| JP | 2016117090 | A | 6/2016 |
| KR | 100660223 | | 12/2006 |
| WO | WO 03/033750 | A1 | 4/2003 |
| WO | WO 2013/007891 | | 1/2013 |
| WO | 2015136347 | A1 | 9/2015 |
| WO | 2017-044769 | A1 | 3/2017 |

OTHER PUBLICATIONS

M. Qian et al., "Ultrasonic Grain Refinement of Magnesium and Its Alloys," Magnesium Alloys—Design, Processing and Properties, Frank Czerwinski (Ed.), pp. 169-186, Jan. 2011.

Bi Qui, et. al, *Effects of Ultrasonic Power on Solidification Structure in AZ318 Alloy Ingots* (2009). pp. 576-579 (with English Abstract).

Jeong Il Young & Young Jig Kim, Nucleation Enhancement of Al Alloys by High Intensity Ultrasound, Japanese Journal of Applied Physics 48, pp. 07GM14-1-07GM14-5 (2009).

Shulin Lü, et. al, *Microstructure and Tensile Properties of Wrough Al Alloy 5052 Produced by Rheo-Squeeze Casting*, Metallurgical and Materials Transactions A, vol. 44A, pp. 2735-2745 (2013).

Abramov, O.V., (1998), "High-Intensity Ultrasonics," Gordon and Breach Science Publishers, Amsterdam, The Netherlands, pp. 523-552.

(56) References Cited

OTHER PUBLICATIONS

Alcoa, (2000), "New Process for Grain Refinement of Aluminum," DOE Project Final Report, Contract No. DE-FC07-98ID13665, Sep. 22, 2000, pp. 1-267.
Cui, Y., Xu, C.L. and Han, Q., (2007), "Microstructure Improvement in Weld Metal Using Ultrasonic Vibrations, Advanced Engineering Materials," v. 9, No. 3, pp. 161-163.
Eskin, G.I., (1998), "Ultrasonic Treatment of Light Alloy Melts," Chapter 5: Continuous Casting of Light Alloys in the Ultrasonic Field; pp. 187-201; Gordon and Breach Science Publishers, Amsterdam, The Netherlands.
Eskin, G.I. (2002) "Effect of Ultrasonic Cavitation Treatment of the Melt on the Microstructure Evolution during Solidification of Aluminum Alloy Ingots," Zeitschrift Fur Metallkunde/Materials Research and Advanced Techniques, v.93, n. 6, Jun. 2002, pp. 502-507.
Greer, A.L., (2004), "Grain Refinement of Aluminum Alloys," in Chu, M.G., Granger, D.A., and Han, Q., (eds.), " Solidification of Aluminum Alloys," Proceedings of a Symposium Sponsored by TMS (The Minerals, Metals & Materials Society), TMS, Warrendale, PA 15086-7528, pp. 131-145.
Han, Q., (2007), The Use of Power Ultrasound for Material Processing, Han, Q., Ludtka, G., and Zhai, Q., (eds), (2007), "Materials Processing under the Influence of External Fields," Proceedings of a Symposium Sponsored by TMS (The Minerals, Metals & Materials Society), TMS, Warrendale, PA 15086-7528, pp. 97-106.
Jackson, K.A., Hunt, J.D., and Uhlmann, D.R., and Seward, T.P., (1966), "On Origin of Equiaxed Zone in Castings," Trans. Metall. Soc. AIME, v. 236, pp. 149-158.
Jian, X., Xu, H., Meek, T.T., and Han, Q., (2005), "Effect of Power Ultrasoud on Solidification of Aluminum A356 Alloy," Materials Letters, v. 59, No. 2-3, pp. 190-193.
Keles, O. And Dundar, M., (2007). "Aluminum Foil: Its Typical Quality Problems and Their Causes," Journal of Materials Processing Technology, v. 186, pp. 125-137.
Liu, C., Pan, Y., and Aoyama, S., (1998),"Microstructure Evolution of Semi-Solid A1-7Si-0.4Mg Alloy by Short Time Supersonic Vibrations" Proceedings of the 5th International Conference on Semi-Solid Processing of Alloys and Composites, Eds.: Bhasin, A.K., Moore, J.J., Young, K.P., and Madison, S., Colorado School of Mines, Golden, Co, pp. 439-447.
Megy, J., Granger, D.A., Sigworth, G.K., and Durst, C.R., (2000), "Effectiveness of In-Situ Aluminum Grain Refining Process," Light Metals, pp. 1-6.
Han et al., "Grain Refining of Pure Aluminum," Light Metals 2012, pp. 967-971.
H. Puga, et. al, Influence of Indirect Ultrasonic Vibration on the Microstructure and Mechanical Behavior of Al—Si—Cu Alloy, Matierial Sci.. & Eng'g A, Oct. 5, 2012, available at www.elsevier.com/locate/msea, pp. 589-595.
Titinan Methong & Bovornchok Poopat, The Effect of Ultrasonic Vibration on Properties of Weld Metal, Key Eng'g Materials, vol. 545, pp. 177-181 (2013).
Yuta Fukui, Yoshiki Tsunekawa & Masahiro Okumiya, Nucleation with Collapse of Acoustic Cavitation in Molten Al—Si Alloys, Advanced Materials Research, vols. 89-91, pp. 190-195 (2010).
Invitation to Pay Additional Fees issued in corresponding International Application No. PCT/S2016/050978 dated Dec. 2, 2016.
Atamanenko TV, Eskin DG, Zhang L, Katgerman L.; "Criteria of grain refinement induced by ultrasonic melt treatment of aluminum alloys containing Zr and Ti"; Aug. 2010, vol. 41, Issue 8, pp. 2056-2066.
Abramov V, Abramov O, Bulgakov V, Sommer F.; "Solidification of aluminium alloys under ultrasonic irradiation using water-cooled resonator"; Sep. 1998, vol. 37, Issues1-2, pp. 27-34. (Abstract Only).
Khalifa W, Tsunekawa Y, El-Hadad S.; "Ultrasonic Rheo-Diecasting of A383 Aluminum Alloy"; Sep. 2016, vol. 256, pp. 282-287 (Abstract Only).
Zhao Y, Zhang Y, Luo Z, Wang Z, Zhang W.; "Effect of Ultrasonic Vibration and Applied Pressure on the Microstructure and Mechanical Property of Al-5.0 Cu-0.6 Mn-0.6 Fe Alloys"; 2016, vol. 850, pp. 559-565. (Abstract Only).
Ruirun C, Deshuang Z, Jingjie G, Tengfei M, Hongsheng D, Yanqing S, Hengzhi F.; "A novel method for grain refinement and microstructure modification in TiAl alloy by ultrasonic vibration"; Jan. 20, 2016; vol. 653, pp. 23-26. (Abstract Only).
Mishra, Sudhansu; "Effects of mould vibration on casting characteristics of Al-6wt%Cu alloy"; 71st World Foundry Congress: Advanced Sustainable Foundry, WFC 2014, 2014; ISBN-13: 9788461700875. (Abstract Only).
Tuan NQ, Puga H, Barbosa J, Pinto Am.; "Grain refinement of Al—Mg—Sc alloy by ultrasonic treatment."; Jan. 2015, vol. 21, Issue 1, pp. 72-78.
Khalifa W, Tsunekawa Y.; "Production of grain-refined AC7A Al—Mg alloy via solidification in ultrasonic field"; Apr. 2016, vol. 26, Issue 4, pp. 930-937 (Abstract Only).
Gen Liang; Chen Shi; Yajun Zhou; Daheng Mao; "Effect of Ultrasonic Treatment on the Solidification Microstructure of Die-Cast 35CrMo Steel" Metals 2016, 6(11), 260.
Selyanin, I.F.; Deev, V.B.; Belov, N.A.; Prikhodko, O.G.; Ponomareva, K.V.; "Physical modifying effects and their influence on the crystallization of casting alloys"; Jul. 2015, vol. 56, Issue 4, pp. 434-436 (Abstract Only).
Ruirun, Chen; Deshuang, Zheng; Jingjie, Guo1; Tengfei, Ma; Hongsheng, Ding; Yanqing, Su; Hengzhi, Fu; "A novel method for grain refinement and microstructure modification in TiAl alloy by ultrasonic vibration"; Jan. 20, 2016, vol. 653, pp. 23-26 (Abstract Only).
Liu X, Osawa Y, Takamori S, Mukai T.; "Grain refinement of AZ91 alloy by introducing ultrasonic vibration during solidification"; Jun. 30, 2008, vol. 62, Issues 17-18, pp. 2872-2875 (Abstract Only).
Shi, Xiao-fang; Chang, Li-zhong; Zhu, Zheng-hai; Wang, Jian-jun; Zhou, Li; "Effect of Noncontact Ultrasonic Technology on Solidification Quality of Electroslag Steel"; Nov. 1, 2016, vol. 23, Issue 11, pp. 1168-1176 (Abstract Only).
Notification of Transmittal of the International Search Report and the Written Opinion of the International Searching Authority issued in International application No. PCT/US2016/050978 dated Feb. 17, 2017.

* cited by examiner

Figure 16

| 1350 EC Rod 0.375" Diameter | | | | | |
|---|---|---|---|---|---|
| | Tensile (KSI) | Elongation % | Conductivity Ranges (IACS%) | Conductivity (IACS%) | Conductivity Standard Deviation |
| Conventional Rod | 14.41 | 20.2 | 61.6 – 62.1 | 61.98 | 0.09 |
| Ultrasonic Processed Rod | 13.93 | 21.1 | 62.0 – 62.3 | 62.17 | 0.13 |

Figure 17

| ACSR Wire 0.130" Diameter | | | | | |
|---|---|---|---|---|---|
| | Tensile (KSI) | Tensile Standard Deviation | Conductivity Ranges (IACS%) | Conductivity (IACS%) | Conductivity Standard Deviation |
| Conventional Rod | 25.37 | 0.61 | 61.1 – 61.7 | 61.49 | 0.18 |
| Ultrasonic Processed Rod | 27.65 | 0.35 | 61.6 – 62.0 | 61.78 | 0.16 |

Figure 18

| 8176 EEE Rod 0.375" Diameter | | | | | |
|---|---|---|---|---|---|
| | Tensile (KSI) | Elongation % | Conductivity Ranges (IACS%) | Conductivity (IACS%) | Conductivity Standard Deviation |
| Conventional Rod | 17.87 | 17.05 | 59.7 – 59.9 | 59.79 | 0.09 |
| Ultrasonic Processed Rod | 18.63 | 19.35 | 60.6 – 60.9 | 60.86 | 0.04 |

Figure 19

| 5154 Aluminum Rod 0.375" Diameter | | | | |
|---|---|---|---|---|
| | Tensile Ranges (KSI) | Tensile (KSI) | Elongation % Ranges | Elongation % |
| Conventional Rod | 32.1 – 33.8 | 32.91 | 18 – 20 | 18.75 |
| Ultrasonic Processed Rod | 33.2 – 34.7 | 33.87 | 18 – 22 | 18.90 |

Figure 20

| 5154 Aluminum Strip 0.016" Thickness | | | | |
|---|---|---|---|---|
| | Tensile Ranges (KSI) | Tensile (KSI) | Elongation % Ranges | Elongation % |
| Conventional Rod | 36.18 – 39.02 | 37.32 | 6.60 – 11.08 | 9.13 |
| Ultrasonic Processed Rod | 36.6 – 39.6 | 37.94 | 8.40 – 9.86 | 9.10 |

Figure 21

| 5356 Aluminum Rod 0.375" Diameter | | | | |
|---|---|---|---|---|
| | Tensile Ranges (KSI) | Tensile (KSI) | Elongation % Ranges | Elongation % |
| Ultrasonic Processed Rod | 40.1 – 42.6 | 41.5 | 18 – 20 | 19.20 |

ULTRASONIC GRAIN REFINING

CROSS-REFERENCE TO RELATED APPLICATION

This application is a continuation of U.S. Ser. No. 15/337,645, filed Oct. 28, 2016, pending, which is a national stage entry under 35 U.S.C. 371 of International application PCT/US2016050978 filed Sep. 9, 2016, published, which claims priority to U.S. Ser. No. 62/372,592 (the entire contents of which are incorporated herein by reference) filed Aug. 9, 2016, expired, entitled ULTRASONIC GRAIN REFINING AND DEGASSING PROCEDURES AND SYSTEMS FOR METAL CASTING; U.S. Ser. No. 62/295,333 (the entire contents of which are incorporated herein by reference) filed Feb. 15, 2016, expired, entitled ULTRASONIC GRAIN REFINING AND DEGASSING FOR METAL CASTING; U.S. Ser. No. 62/267,507 (the entire contents of which are incorporated herein by reference) filed Dec. 15, 2015, expired, entitled ULTRASONIC GRAIN REFINING AND DEGASSING OF MOLTEN METAL; and U.S. Ser. No. 62/216,842 (the entire contents of which are incorporated herein by reference) filed Sep. 10, 2015, expired, entitled ULTRASONIC GRAIN REFINING ON A CONTINUOUS CASTING BELT. This application is related to U.S. Ser. No. 62/113,882 (the entire contents of which are incorporated herein by reference) filed Feb. 9, 2015, expired, entitled ULTRASONIC GRAIN REFINING.

BACKGROUND

Field

The present invention is related to a method for producing metal castings with controlled grain size, a system for producing the metal castings, and products obtained by the metal castings.

Description of the Related Art

Considerable effort has been expended in the metallurgical field to develop techniques for casting molten metal into continuous metal rod or cast products. Both batch casting and continuous castings are well developed. There are a number of advantages of continuous casting over batch castings although both are prominently used in the industry.

In the continuous production of metal cast, molten metal passes from a holding furnace into a series of launders and into the mold of a casting wheel where it is cast into a metal bar. The solidified metal bar is removed from the casting wheel and directed into a rolling mill where it is rolled into continuous rod. Depending upon the intended end use of the metal rod product and alloy, the rod may be subjected to cooling during rolling or the rod may be cooled or quenched immediately upon exiting from the rolling mill to impart thereto the desired mechanical and physical properties. Techniques such as those described in U.S. Pat. No. 3,395,560 to Cofer et al. (the entire contents of which are incorporated herein by reference) have been used to continuously-process a metal rod or bar product.

U.S. Pat. No. 3,938,991 to Sperry et al. (the entire contents of which are incorporated herein by reference) shows that there has been a long recognized problem with casting of "pure" metal products. By "pure" metal castings, this term refers to a metal or a metal alloy formed of the primary metallic elements designed for a particular conductivity or tensile strength or ductility without inclusion of separate impurities added for the purpose of grain control.

Grain refining is a process by which the crystal size of the newly formed phase is reduced by either chemical or physical/mechanical means. Grain refiners are usually added into molten metal to significantly reduce the grain size of the solidified structure during the solidification process or the liquid to solid phase transition process.

Indeed, a WIPO Patent Application WO/2003/033750 to Boily et al. (the entire contents of which are incorporated herein by reference) describes the specific use of "grain refiners." The '750 application describes in their background section that, in the aluminum industry, different grain refiners are generally incorporated in the aluminum to form a master alloy. A typical master alloys for use in aluminum casting comprise from 1 to 10% titanium and from 0.1 to 5% boron or carbon, the balance consisting essentially of aluminum or magnesium, with particles of $TiB_2$ or TiC being dispersed throughout the matrix of aluminum. According to the '750 application, master alloys containing titanium and boron can be produced by dissolving the required quantities of titanium and boron in an aluminum melt. This is achieved by reacting molten aluminum with $KBF_4$ and $K_2TiF_6$ at temperatures in excess of 800° C. These complex halide salts react quickly with molten aluminum and provide titanium and boron to the melt.

The '750 application also describes that, as of 2002, this technique was used to produce commercial master alloys by almost all grain refiner manufacturing companies. Grain refiners frequently referred to as nucleating agents are still used today. For example, one commercial supplier of a TIBOR master alloy describes that the close control of the cast structure is a major requirement in the production of high quality aluminum alloy products.

Prior to this invention, grain refiners were recognized as the most effective way to provide a fine and uniform as-cast grain structure. The following references (all the contents of which are incorporated herein by reference) provide details of this background work:

Abramov, O. V., (1998), "*High-Intensity Ultrasonics*," Gordon and Breach Science Publishers, Amsterdam, The Netherlands, pp. 523-552.

Alcoa, (2000), "*New Process for Grain Refinement of Aluminum," DOE Project Final Report, Contract No. DE-FCO*7-98*ID*13665, Sep. 22, 2000.

Cui, Y, Xu, C. L. and Han, Q., (2007), "*Microstructure Improvement in Weld Metal Using Ultrasonic Vibrations, Advanced Engineering Materials*," v. 9, No. 3, pp. 161-163.

Eskin, G. I., (1998), "*Ultrasonic Treatment of Light Alloy Melts*," Gordon and Breach Science Publishers, Amsterdam, The Netherlands.

Eskin, G. I. (2002) "*Effect of Ultrasonic Cavitation Treatment of the Melt on the Microstructure Evolution during Solidification of Aluminum Alloy Ingots," Zeitschrift Fur Metallkunde/Materials Research and Advanced Techniques*, v. 93, n. 6, June, 2002, pp. 502-507.

Greer, A. L., (2004), "*Grain Refinement of Aluminum Alloys*," in Chu, M. G., Granger, D. A., and Han, Q., (eds.), "*Solidification of Aluminum Alloys," Proceedings of a Symposium Sponsored by TMS* (*The Minerals, Metals & Materials Society*), *TMS*, Warrendale, Pa. 15086-7528, pp. 131-145.

Han, Q., (2007), *The Use of Power Ultrasound for Material Processing*," Han, Q., Ludtka, G., and Zhai, Q., (eds), (2007), "*Materials Processing under the Influence of External Fields," Proceedings of a Symposium Sponsored*

*by TMS* (*The Minerals, Metals & Materials Society*), *TMS*, Warrendale, Pa. 15086-7528, pp. 97-106.

Jackson, K. A., Hunt, J. D., and Uhlmann, D. R., and Seward, T. P., (1966), "*On Origin of Equiaxed Zone in Castings,*" *Trans. Metall. Soc. AIME*, v. 236, pp. 149-158.

Jian, X., Xu, H., Meek, T. T., and Han, Q., (2005), "*Effect of Power Ultrasound on Solidification of Aluminum A356 Alloy,*" *Materials Letters*, v. 59, no. 2-3, pp. 190-193.

Keles, O. and Dundar, M., (2007). "*Aluminum Foil. Its Typical Quality Problems and Their Causes,*" *Journal of Materials Processing Technology*, v. 186, pp. 125-137.

Liu, C., Pan, Y, and Aoyama, S., (1998), *Proceedings of the 5th International Conference on Semi-Solid Processing of Alloys and Composites*, Eds.: Bhasin, A. K., Moore, J. J., Young, K. P., and Madison, S., Colorado School of Mines, Golden, Colo., pp. 439-447.

Megy, J., (1999), "Molten Metal Treatment," U.S. Pat. No. 5,935,295, August, 1999

Megy, J., Granger, D. A., Sigworth, G. K., and Durst, C. R., (2000), "*Effectiveness of In-Situ Aluminum Grain Refining Process*," Light Metals, pp. 1-6.

Cui et al., "*Microstructure Improvement in Weld Metal Using Ultrasonic Vibrations,*" *Advanced Engineering Materials,* 2007, vol. 9, no. 3, pp. 161-163.

Han et al., "*Grain Refining of Pure Aluminum,*" *Light Metals* 2012, pp. 967-971.

Prior to this invention, U.S. Pat. Nos. 8,574,336 and 8,652,397 (the entire contents of each patent are incorporated herein by reference) described methods for reducing the amount of a dissolved gas (and/or various impurities) in a molten metal bath (e.g., ultrasonic degassing) for example by introducing a purging gas into the molten metal bath in close proximity to the ultrasonic device. These patents will be referred to hereinafter as the '336 patent and the '397 patent.

SUMMARY

In one embodiment of the present invention, there is provided a molten metal processing device for attachment to a casting wheel on a casting mill. The device includes an assembly mounted on the casting wheel, including at least one vibrational energy source which supplies vibrational energy to molten metal cast in the casting wheel while the molten metal in the casting wheel is cooled and includes a support device holding the vibrational energy source.

In one embodiment of the present invention, there is provided a method for forming a metal product. The method provides molten metal into a containment structure included as a part of a casting mill. The method cools the molten metal in the containment structure, and couples vibrational energy into the molten metal in the containment structure.

In one embodiment of the present invention, there is provided a system for forming a metal product. The system includes 1) the molten metal processing device described above and 2) a controller including data inputs and control outputs, and programmed with control algorithms which permit operation of the above-described method steps.

In one embodiment of the present invention, there is provided a molten metal processing device. The device includes a source of molten metal, an ultrasonic degasser including an ultrasonic probe inserted into the molten metal, a casting for reception of the molten metal, an assembly mounted on the casting, including at least one vibrational energy source which supplies vibrational energy to molten metal cast in the casting while the molten metal in the casting is cooled, and a support device holding the at least one vibrational energy source.

It is to be understood that both the foregoing general description of the invention and the following detailed description are exemplary, but are not restrictive of the invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 16 is tabular comparison of a conventional 1350 EC aluminum alloy rod (with chemical grain refiners) to a 1350 EC aluminum alloy rod (with ultrasonic grain refinement);

FIG. 17 is tabular comparison of a conventional ACSR aluminum Wire 0.130" Diameter (with chemical grain refiners) to ACSR aluminum Wire 0.130" Diameter (with ultrasonic grain refinement);

FIG. 18 is tabular comparison of a conventional 8176 EEE aluminum alloy rod (with chemical grain refiners) to an 8176 EEE aluminum alloy rod (with ultrasonic grain refinement);

FIG. 19 is tabular comparison of a conventional 5154 aluminum alloy rod (with chemical grain refiners) to a 5154 aluminum alloy rod (with ultrasonic grain refinement);

FIG. 20 is tabular comparison of a conventional 5154 aluminum alloy strip (with chemical grain refiners) to a 5154 aluminum alloy strip (with ultrasonic grain refinement); and FIG. 21 is tabular depiction of the properties of a 5356 aluminum alloy rod (with ultrasonic grain refinement).

DETAILED DESCRIPTION

Figure 1:
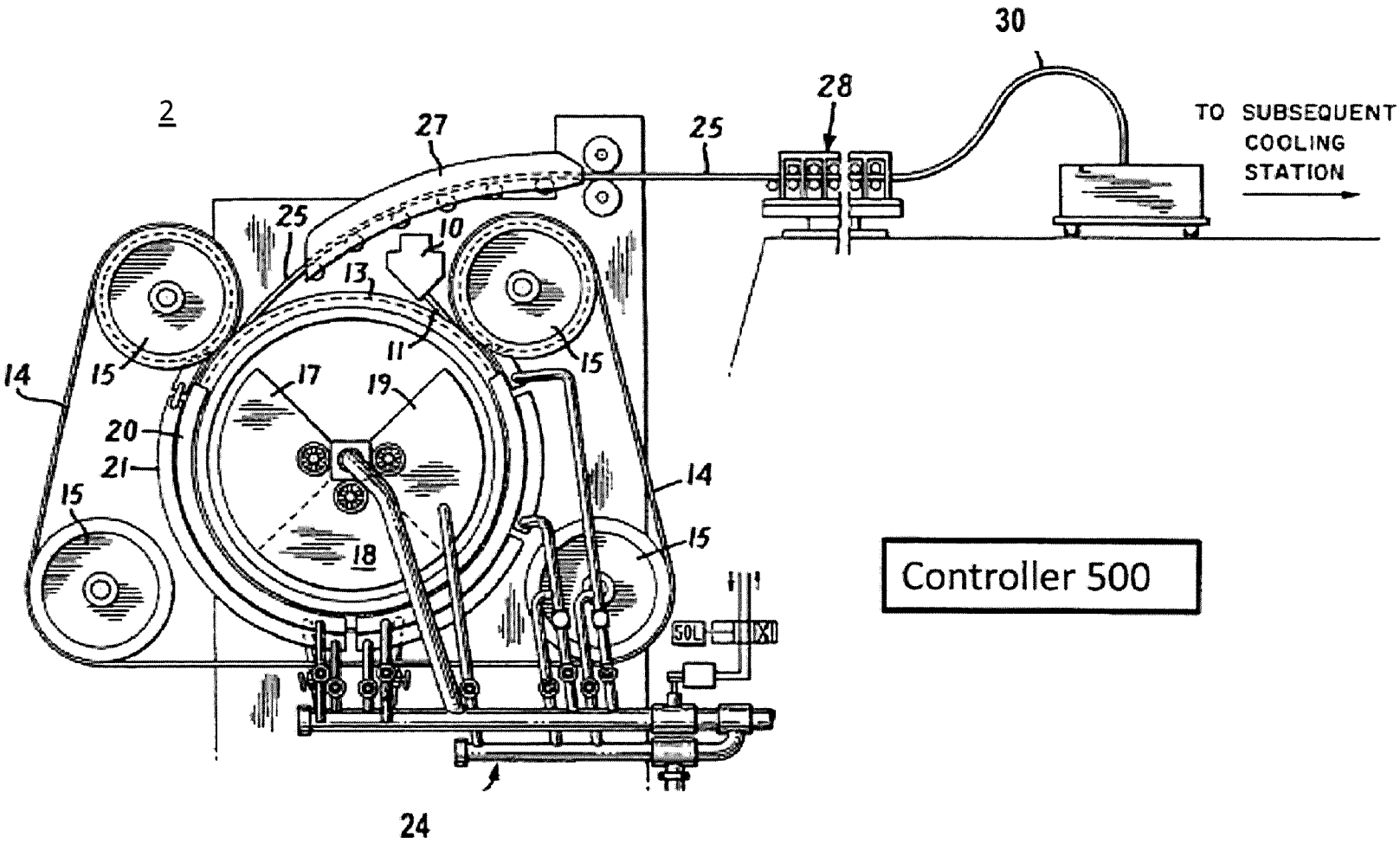
FIG. 1 is a schematic of a continuous casting mill according to one embodiment of the invention.

Grain refining of metals and alloys is important for many reasons, including maximizing ingot casting rate, improving resistance to hot tearing, minimizing elemental segregation, enhancing mechanical properties, particularly ductility, improving the finishing characteristics of wrought products and increasing the mold filling characteristics, and decreasing the porosity of foundry alloys. Usually grain refining is one of the first processing steps for the production of metal and alloy products, especially aluminum alloys and magnesium alloys, which are two of the lightweight materials used increasingly in the aerospace, defense, automotive, construction, and packaging industry. Grain refining is also an important processing step for making metals and alloys castable by eliminating columnar grains and forming equiaxed grains.

Grain refining is a solidification processing step by which the crystal size of the solid phases is reduced by either chemical, physical, or mechanical means in order to make alloys castable and to reduce defect formation. Currently, aluminum production is grain refined using TIBOR, resulting in the formation of an equiaxed grain structure in the solidified aluminum. Prior to this invention, use of impurities or chemical "grain refiners" was the only way to address the long recognized problem in the metal casting industry of columnar grain formation in metal castings. Additionally, prior to this invention, a combination of 1) ultrasonic degassing to remove impurities from the molten metal (prior to casting) along and 2) the above-noted ultrasonic grain refining (i.e., at least one vibrational energy source) had not been undertaken.

However, there are large costs associated with using TIBOR and mechanical restraints due to the input of those inoculants into the melt. Some of the restraints include ductility, machinability, and electrical conductivity.

Despite the cost, approximately 68% of the aluminum produced in the United States is first cast into ingot prior to further processing into sheets, plates, extrusions, or foil. The direct chill (DC) semi-continuous casting process and continuous casting (CC) process has been the mainstay of the aluminum industry due largely to its robust nature and relative simplicity. One issue with the DC and CC processes is the hot tearing formation or cracking formation during ingot solidification. Basically, almost all ingots would be cracked (or not castable) without using grain refining.

Still, the production rates of these modern processes are limited by the conditions to avoid cracking formation. Grain refining is an effective way to reduce the hot tearing tendency of an alloy, and thus to increase the production rates. As a result, a significant amount of effort has been concentrated on the development of powerful grain refiners that can produce grain sizes as small as possible. Superplasticity can be achieved if the grain size can be reduced to the sub-micron level, which permits alloys not only to be cast at much faster rates but also rolled/extruded at lower temperatures at much faster rates than ingots are processed today, leading to significant cost savings and energy savings.

At present, nearly all aluminum cast in the world either from primary (approximately 20 billion kg) or secondary and internal scrap (25 billion kg) is grain refined with heterogeneous nuclei of insoluble $TiB_2$ nuclei approximately a few microns in diameter, which nucleate a fine grain structure in aluminum. One issue related to the use of chemical grain refiners is the limited grain refining capability. Indeed, the use of chemical grain refiners causes a limited decrease in aluminum grain size, from a columnar structure with linear grain dimensions of something over 2,500 m, to equiaxed grains of less than 200 μm. Equiaxed grains of 100 m in aluminum alloys appear to be the limit that can be obtained using the chemical grain refiners commercially available.

The productivity can be significantly increased if the grain size can be further reduced. Grain size in the sub-micron level leads to superplasticity that makes forming of aluminum alloys much easier at room temperatures.

Another issue related to the use of chemical grain refiners is the defect formation associated with the use of grain refiners. Although considered in the prior art to be necessary for grain refining, the insoluble, foreign particles are otherwise undesirable in aluminum, particularly in the form of particle agglomerates ("clusters"). The current grain refiners, which are present in the form of compounds in aluminum base master alloys, are produced by a complicated string of mining, beneficiation, and manufacturing processes. The master alloys used now frequently contain potassium aluminum fluoride (KAlF) salt and aluminum oxide impurities (dross) which arise from the conventional manufacturing process of aluminum grain refiners. These give rise to local defects in aluminum (e.g. "leakers" in beverage cans and "pin holes" in thin foil), machine tool abrasion, and surface finish problems in aluminum. Data from one of the aluminum cable companies indicate that 25% of the production defects is due to $TiB_2$ particle agglomerates, and another 25% of defects is due to dross that is entrapped into aluminum during the casting process. $TiB_2$ particle agglomerates often break the wires during extrusion, especially when the diameter of the wires is smaller than 8 mm.

Another issue related to the use of chemical grain refiners is the cost of the grain refiners. This is extremely true for the production of magnesium ingots using Zr grain refiners. Grain refining using Zr grain refiners costs about an extra $1 per kilogram of Mg casting produced. Grain refiners for aluminum alloys cost around $1.50 per kilogram.

Another issue related to the use of chemical grain refiners is the reduced electrical conductivity. The use of chemical grain refiners introduces in excess amount of Ti in aluminum, causes a substantial decrease in electrical conductivity of pure aluminum for cable applications. In order to maintain certain conductivity, companies have to pay extra money to use purer aluminum for making cables and wires.

A number of other grain refining methods, in addition to the chemical methods, have been explored in the past century. These methods include using physical fields, such as magnetic and electro-magnetic fields, and using mechanical vibrations. High-intensity, low-amplitude ultrasonic vibration is one of the physical/mechanical mechanisms that has been demonstrated for grain refining of metals and alloys without using foreign particles. However, experimental results, such as from Cui et al, 2007 noted above, were obtained in small ingots up to a few pounds of metal subjected to a short period of time of ultrasonic vibration. Little effort has been carried out on grain refining of CC or DC casting ingots/billets using high-intensity ultrasonic vibrations.

Some of the technical challenges addressed in the present invention for grain refining are (1) the coupling of ultrasonic energy to the molten metal for extended times, (2) maintaining the natural vibration frequencies of the system at elevated temperatures, and (3) increasing the grain refining efficiency of ultrasonic grain refining when the temperature of the ultrasonic wave guide is hot. Enhanced cooling for both the ultrasonic wave guide and the ingot (as described below) is one of the solutions presented here for addressing these challenges.

Moreover, another technical challenge addressed in the present invention relates to the fact that, the purer the aluminum, the harder it is to obtain equiaxed grains during the solidification process. Even with the use of external grain refiners such as TiB (Titanium boride) in pure aluminum such as 1000, 1100 and 1300 series of aluminum, it remains difficult to obtain an equiaxed grain structure. However, using the novel grain refining technology described herein, substantial grain refining has been obtained.

In one embodiment of the invention, the present invention partially suppresses columnar grain formation without the necessity of introducing grain refiners. The application of vibrational energy to the molten metal as it is being poured into a casting permits the realization of grain sizes comparable to or smaller than that obtained with state of the art grain refiners such as TIBOR master alloy.

As used herein, embodiments of the present invention will be described using terminologies commonly employed by those skilled in the art to present their work. These terms are to be accorded the common meaning as understood by those of the ordinary skill in the arts of materials science, metallurgy, metal casting, and metal processing. Some terms taking a more specialized meaning are described in the embodiments below. Nevertheless, the term "configured to" is understood herein to depict appropriate structures (illustrated herein or known or implicit from the art) permitting an object thereof to perform the function which follows the "configured to" term. The term "coupled to" means that one object coupled to a second object has the necessary structures to support the first object in a position relative to the second object (for example, abutting, attached, displaced a predetermined distance from, adjacent, contiguous, joined together, detachable from one another, dismountable from each other, fixed together, in sliding contact, in rolling contact) with or without direct attachment of the first and second objects together.

U.S. Pat. No. 4,066,475 to Chia et al. (the entire contents of which are incorporated herein by reference) describes a continuous casting process. In general, FIG. 1 depicts continuous casting system having a casting mill 2 including a pouring spout 11 which directs the molten metal to a peripheral groove contained on a rotary mold ring 13. An endless flexible metal band 14 encircles both a portion of the mold ring 13 as well as a portion of a set of band-positioning rollers 15 such that a continuous casting mold is defined by the groove in the mold ring 13 and the overlying metal band 14. A cooling system is provided for cooling the apparatus and effecting controlled solidification of the molten metal during its transport on the rotary mold ring 13. The cooling system includes a plurality of side headers 17, 18, and 19 disposed on the side of the mold ring 13 and inner and outer band headers 20 and 21, respectively, disposed on the inner and outer sides of the metal band 14 at a location where it encircles the mold ring. A conduit network 24 having suitable valving is connected to supply and exhaust coolant to the various headers so as to control the cooling of the apparatus and the rate of solidification of the molten metal.

By such a construction, molten metal is fed from the pouring spout 11 into the casting mold and is solidified and partially cooled during its transport by circulation of coolant through the cooling system. A solid cast bar 25 is withdrawn from the casting wheel and fed to a conveyor 27 which conveys the cast bar to a rolling mill 28. It should be noted that the cast bar 25 has only been cooled an amount sufficient to solidify the bar, and the bar remains at an elevated temperature to allow an immediate rolling operation to be performed thereon. The rolling mill 28 can include a tandem array of rolling stands which successively roll the bar into a continuous length of wire rod 30 which has a substantially uniform, circular cross-section.

Figure 2:
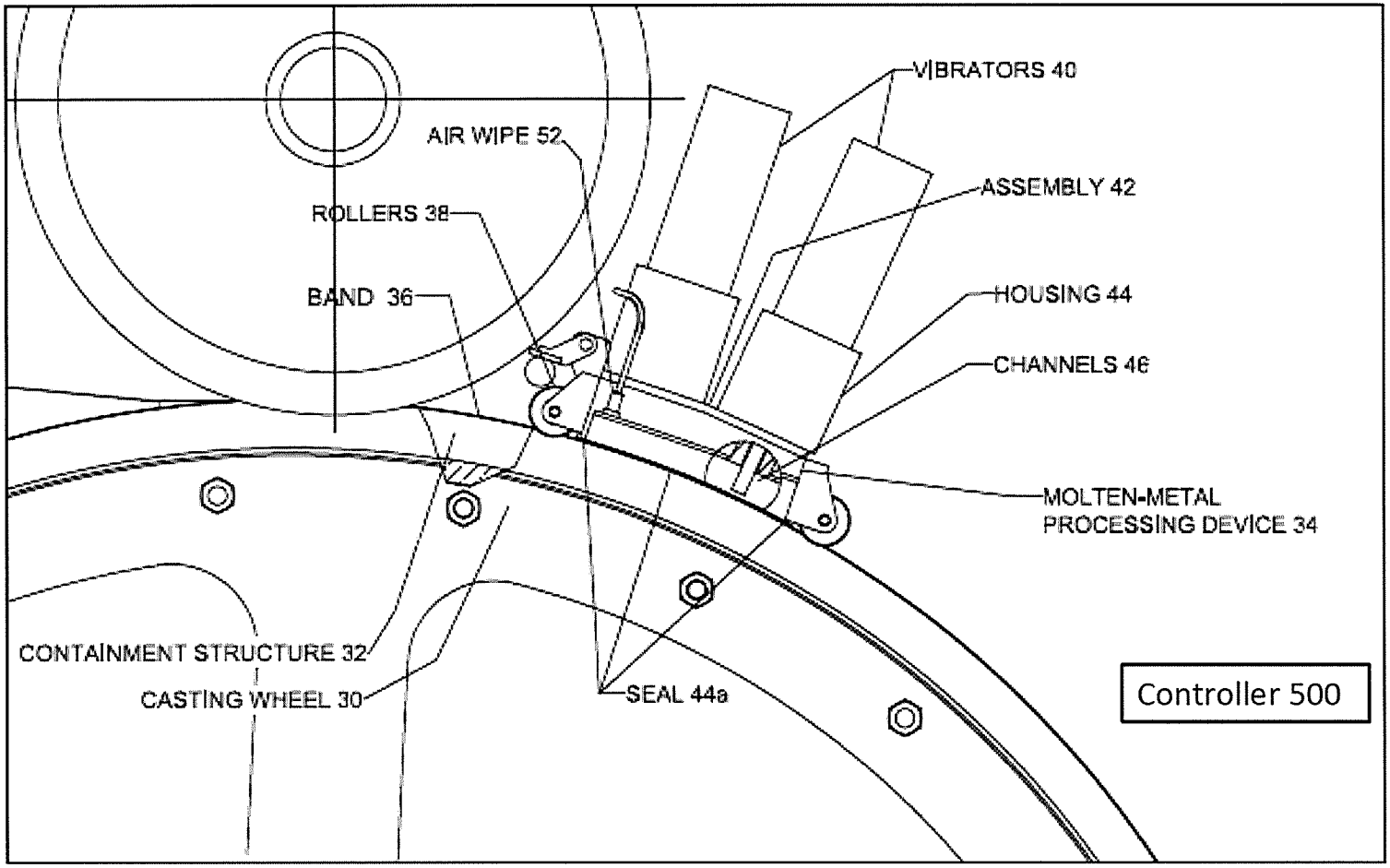
FIG. 2 is a schematic of a casting wheel configuration according to one embodiment of the invention utilizing at least one ultrasonic vibrational energy source.

FIGS. 1 and 2 show controller 500 which controls the various parts of the continuous casting system shown therein, as discussed in more detail below. Controller 500 may include one or more processors with programmed instructions (i.e., algorithms) to control the operation of the continuously casting system and the components thereof.

In one embodiment of the invention, as shown in FIG. 2, casting mill 2 includes a casting wheel 30 having a containment structure 32 (e.g., a trough or channel in the casting wheel 30) in which molten metal is poured (e.g., cast) and a molten metal processing device 34. A band 36 (e.g., a steel flexible metal band) confines the molten metal to the containment structure 32 (i.e., the channel). Rollers 38 allow the molten metal processing device 34 to remain in a stationaly position on the rotating casting wheel as the molten metal solidifies in the channel of the casting wheel and is conveyed away from the molten metal processing device 34. In one embodiment of the invention, molten metal processing device 34 includes an assembly 42 mounted on the casting wheel 30. The assembly 42 includes at least one vibrational energy source (e.g., vibrator 40), a housing 44 (i.e., a support device) holding the vibrational energy source 42. The assembly 42 includes at least one cooling channel 46 for transport of a cooling medium therethrough. The flexible band 36 is sealed to the housing 44 by a seal **44*a* attached to the underside of the housing, thereby permitting the cooling medium from the cooling channel to flow along a side of the flexible band opposite the molten metal in the channel of the casting wheel. An air wipe 52 directs air (as a safety precaution) such that any water leaking from the cooling channel will be directed along a direction away from the casting source of the molten metal. Seal 44*a* can be made from a number of materials including ethylene propylene, viton, buna-n (nitrile), neoprene, silicone rubber, urethane, fluorosilicone, polytetrafluoroethylene as well as other known sealant materials. In one embodiment of the invention, a guide device (e.g., rollers 38) guides the molten metal processing device 34 with respect to the rotating casting wheel 30. The cooling medium provides cooling to the molten metal in the containment structure 32 and/or the at least one vibrational energy source 40. In one embodiment of the invention, components of the molten metal processing device 34 including the housing can be made from a metal such titanium, stainless steel alloys, low carbon steels or H13 steel, other high-temperature materials, a ceramic, a composite, or a polymer. Components of the molten metal processing device 34** can be made from one or more of niobium, a niobium alloy, titanium, a titanium alloy, tantalum, a tantalum alloy, copper, a copper alloy, rhenium, a rhenium alloy, steel, molybdenum, a molybdenum alloy, stainless steel, and a ceramic. The ceramic can be a silicon nitride ceramic, such as for example a silica alumina nitride or SIALON.

In one embodiment of the invention, as a molten metal passes under the metal band 36 under vibrator 40, vibrational energy is supplied to the molten metal as the metal begins to cool and solidify. In one embodiment of the invention, the vibrational energy is imparted with ultrasonic transducers generated for example by piezoelectric devices ultrasonic transducer. In one embodiment of the invention, the vibrational energy is imparted with ultrasonic transducers generated for example by a magnetostrictive transducer. In one embodiment of the invention, the vibrational energy is imparted with mechanically driven vibrators (to be discussed later). The vibrational energy in one embodiment permits the formation of multiple small seeds, thereby producing a fine grain metal product.

In one embodiment of the invention, ultrasonic grain refining involves application of ultrasonic energy (and/or other vibrational energy) for the refinement of the grain size. While the invention is not bound to any particular theory, one theory is that the injection of vibrational energy (e.g., ultrasonic power) into a molten or solidifying alloy can give rise to nonlinear effects such as cavitation, acoustic streaming, and radiation pressure. These nonlinear effects can be used to nucleate new grains, and break up dendrites during solidification process of an alloy.

Under this theory, the grain refining process can be divided into two stages: 1) nucleation and 2) growth of the newly formed solid from the liquid. Spherical nuclei are formed during the nucleation stage. These nuclei develop into dendrites during the growth stage. Unidirectional growth of dendrites leads to the formation of columnar grains potentially causing hot tearing/cracking and non-uniform distribution of the secondary phases. This in turn can lead to poor castability. On the other hand, uniform growth of dendrites in all directions (such as possible with the present invention) leads to the formation of equiaxed grains. Castings/ingots containing small and equiaxed grains have excellent formability.

Under this theory, when the temperature in an alloy is below the liquidus temperature; nucleation may occur when the size of the solid embryos is larger than a critical size given in the following equation:

$$r^* = -\frac{2\sigma_{sl}}{\Delta G_V}$$

where r* is the critical size, $\sigma_{sl}$ is the interfacial energy associated with the solid-liquid interface, and $\Delta G_V$, is the Gibbs free energy associated with the transformation of a unit volume of liquid into solid.

Under this theory, the Gibbs free energy, ΔG, decreases with increasing size of the solid embryos when their sizes are larger than r*, indicating the growth of the solid embryo is thermodynamically favorable. Under such conditions, the solid embryos become stable nuclei. However, homogeneous nucleation of solid phase having size greater than r* occurs only under extreme conditions that require large undercooling in the melt.

Under this theory, the nuclei formed during solidification can grow into solid grains known as dendrites. The dendrites can also be broken into multiple small fragments by application of the vibrational energy. The dendritic fragments thus formed can grow into new grains and result in the formation of small grains; thus creating an equiaxed grain structure.

While not bound to any particular theory, a relatively small amount of undercooling to the molten metal (e.g., less than 2, 5, 10, or 15° C.) at the top of the channel of casting wheel 30 (for example against the underside of band 36) results in a layer of small nuclei of pure aluminum (or other metal or alloy) being formed against the steel band. The vibrational energy (e.g., the ultrasonic or the mechanically driven vibrations) release these nuclei which then are used as nucleating agents during solidification resulting in a uniform grain structure. Accordingly, in one embodiment of the invention, the cooling method employed ensures that a small amount of undercooling at the top of the channel of casting wheel 30 against the steel band results in small nuclei of the material being processed into the molten metal as the molten metal continues to cool. The vibrations acting on band 36 serve to disperse these nuclei into the molten metal in the channel of casting wheel 30 and/or can serve to break up dendrites that form in the undercooled layer. For example, vibrational energy imparted into the molten metal as it cools can by cavitation (see below) break up dendrites to form new nuclei. These nuclei and fragments of dendrites can then be used to form (promote) equiaxed grains in the mold during solidification resulting in a uniform grain structure.

In other words, ultrasonic vibrations transmitted into the undercooled liquid metal create nucleation sites in the metals or metallic alloys to refine the grain size. The nucleation sites can be generated via the vibrational energy acting as described above to break up the dendrites creating in the molten metal numerous nuclei which are not dependent on foreign impurities. In one aspect, the channel of the casting wheel 30 can be a refractory metal or other high temperature material such as copper, irons and steels, niobium, niobium and molybdenum, tantalum, tungsten, and rhenium, and alloys thereof including one or more elements such as silicon, oxygen, or nitrogen which can extend the melting points of these materials.

In one embodiment of the invention, the source of ultrasonic vibrations for vibrational energy source 40 provides a power of 1.5 kW at an acoustic frequency of 20 kHz. This invention is not restricted to those powers and frequencies. Rather, a broad range of powers and ultrasonic frequencies can be used although the following ranges are of interest.

Power: In general, powers between 50 and 5000 W for each sonotrode, depending on the dimensions of the sonotrode or probe. These powers are typically applied to the sonotrode to ensure that the power density at the end of the sonotrode is higher than 100 W/cm$^2$, which may be considered the threshold for causing cavitation in molten metals depending on the cooling rate of the molten metal, the molten metal type, and other factors. The powers at this area can range from 50 to 5000 W, 100 to 3000 W, 500 to 2000 W, 1000 to 1500 W or any intermediate or overlapping range. Higher powers for larger probe/sonotrode and lower powers for smaller probe are possible. In various embodiments of the invention, the applied vibrational energy power density can range from 10 W/cm$^2$ to 500 W/cm$^2$, or 20 W/cm$^2$ to 400 W/cm$^2$, or 30 W/cm$^2$ to 300 W/cm$^2$, or 50

$W/cm^2$ to 200 $W/cm^2$, or 70 $W/cm^2$ to 150 $W/cm^2$, or any intermediate or overlapping ranges thereof.

Frequency: In general, 5 to 400 kHz (or any intermediate range) may be used. Alternatively, 10 and 30 kHz (or any intermediate range) may be used. Alternatively, 15 and 25 kHz (or any intermediate range) may be used. The frequency applied can range from 5 to 400 KHz, 10 to 30 kHz, 15 to 25 kHz, 10 to 200 KHz, or 50 to 100 kHz or any intermediate or overlapping ranges thereof.

In one embodiment of the invention, disposed coupled to the cooling channels 46 is at least one vibrator 40 which in the case of an ultrasonic wave probe (or sonotrode, a piezoelectric transducer, or ultrasonic radiator, or magnetostrictive element) of an ultrasonic transducer provides ultrasonic vibrational energy through the cooling medium as well as through the assembly 42 and the band 36 into the liquid metal. In one embodiment of the invention, ultrasonic energy is supplied from a transducer that is capable of converting electrical currents to mechanical energy thus creating vibrational frequencies above 20 kHz (e.g., up to 400 kHz), with the ultrasonic energy being supplied from either or both piezoelectric elements or magnetostrictive elements.

In one embodiment of the invention, an ultrasonic wave probe is inserted into cooling channel 46 to be in contact with a liquid cooling medium. In one embodiment of the invention, a separation distance from a tip of the ultrasonic wave probe to the band 36, if any, is variable. The separation distance may be for example less than 1 mm, less than 2 mm, less than 5 mm, less than 1 cm, less than 2 cm, less than 5 cm, less than 10 cm, less than 20, or less than 50 cm. In one embodiment of the invention, more than one ultrasonic wave probe or an array of ultrasonic wave probes can be inserted into cooling channel 46 to be in contact with a liquid cooling medium. In one embodiment of the invention, the ultrasonic wave probe can be attached to a wall of assembly 42.

In one aspect of the invention, piezoelectric transducers supplying the vibrational energy can be formed of a ceramic material that is sandwiched between electrodes which provide attachment points for electrical contact. Once a voltage is applied to the ceramic through the electrodes, the ceramic expands and contracts at ultrasonic frequencies. In one embodiment of the invention, piezoelectric transducer serving as vibrational energy source 40 is attached to a booster, which transfers the vibration to the probe. U.S. Pat. No. 9,061,928 (the entire contents of which are incorporated herein by reference) describes an ultrasonic transducer assembly including an ultrasonic transducer, an ultrasonic booster, an ultrasonic probe, and a booster cooling unit. The ultrasonic booster in the '928 patent is connected to the ultrasonic transducer to amplify acoustic energy generated by the ultrasonic transducer and transfer the amplified acoustic energy to the ultrasonic probe. The booster configuration of the '928 patent can be useful here in the present invention to provide energy to the ultrasonic probes directly or indirectly in contact with the liquid cooling medium discussed above.

Indeed, in one embodiment of the invention, an ultrasonic booster is used in the realm of ultrasonics to amplify or intensify the vibrational energy created by a piezoelectric transducer. The booster does not increase or decrease the frequency of the vibrations, it increases the amplitude of the vibration. (When a booster is installed backwards, it can also compress the vibrational energy.) In one embodiment of the invention, a booster connects between the piezoelectric transducer and the probe. In the case of using a booster for ultrasonic grain refining, below are an exemplary number of method steps illustrating the use of a booster with a piezoelectric vibrational energy source:

1) An electrical current is supplied to the piezoelectric transducer. The ceramic pieces within the transducer expand and contract once the electrical current is applied, this converts the electrical energy to mechanical energy.
2) Those vibrations in one embodiment are then transferred to a booster, which amplifies or intensifies this mechanical vibration.
3) The amplified or intensified vibrations from the booster in one embodiment are then propagated to the probe. The probe is then vibrating at the ultrasonic frequencies, thus creating cavitations.
4) The cavitations from the vibrating probe impact the casting band, which in one embodiment is in contact with the molten metal.
5) The cavitations in one embodiment break up the dendrites and creating an equiaxed grain structure.

With reference to FIG. 2, the probe is coupled to the cooling medium flowing through molten metal processing device 34. Cavitations, that are produced in the cooling medium via the probe vibrating at ultrasonic frequencies, impact the band 36 which is in contact with the molten aluminum in the containment structure 32.

Figure 13:
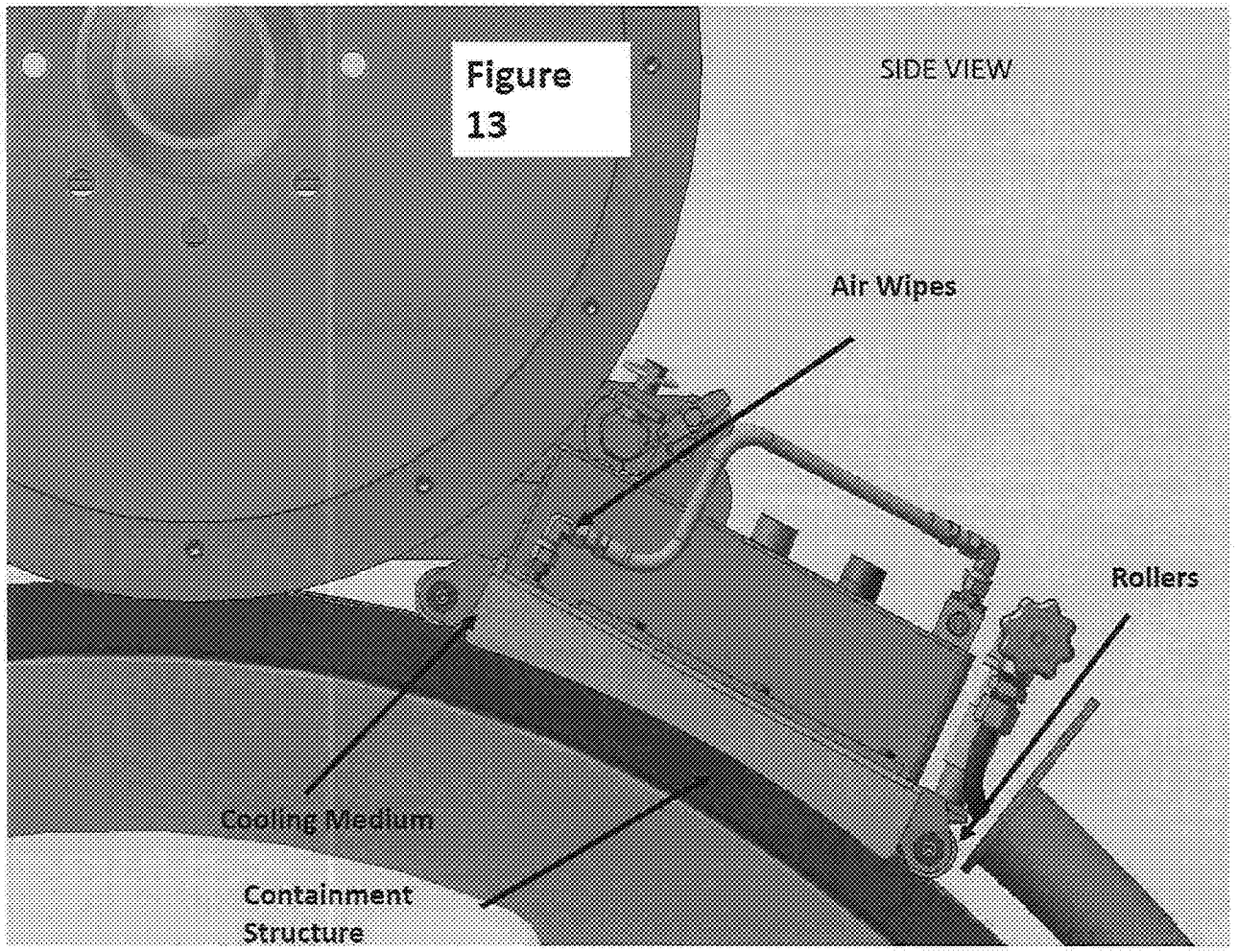
FIG. 13 is a schematic side view of a casting wheel configuration according to one embodiment of the invention utilizing for the at least one ultrasonic vibrational energy source a magnetostrictive element.
Figure 14:
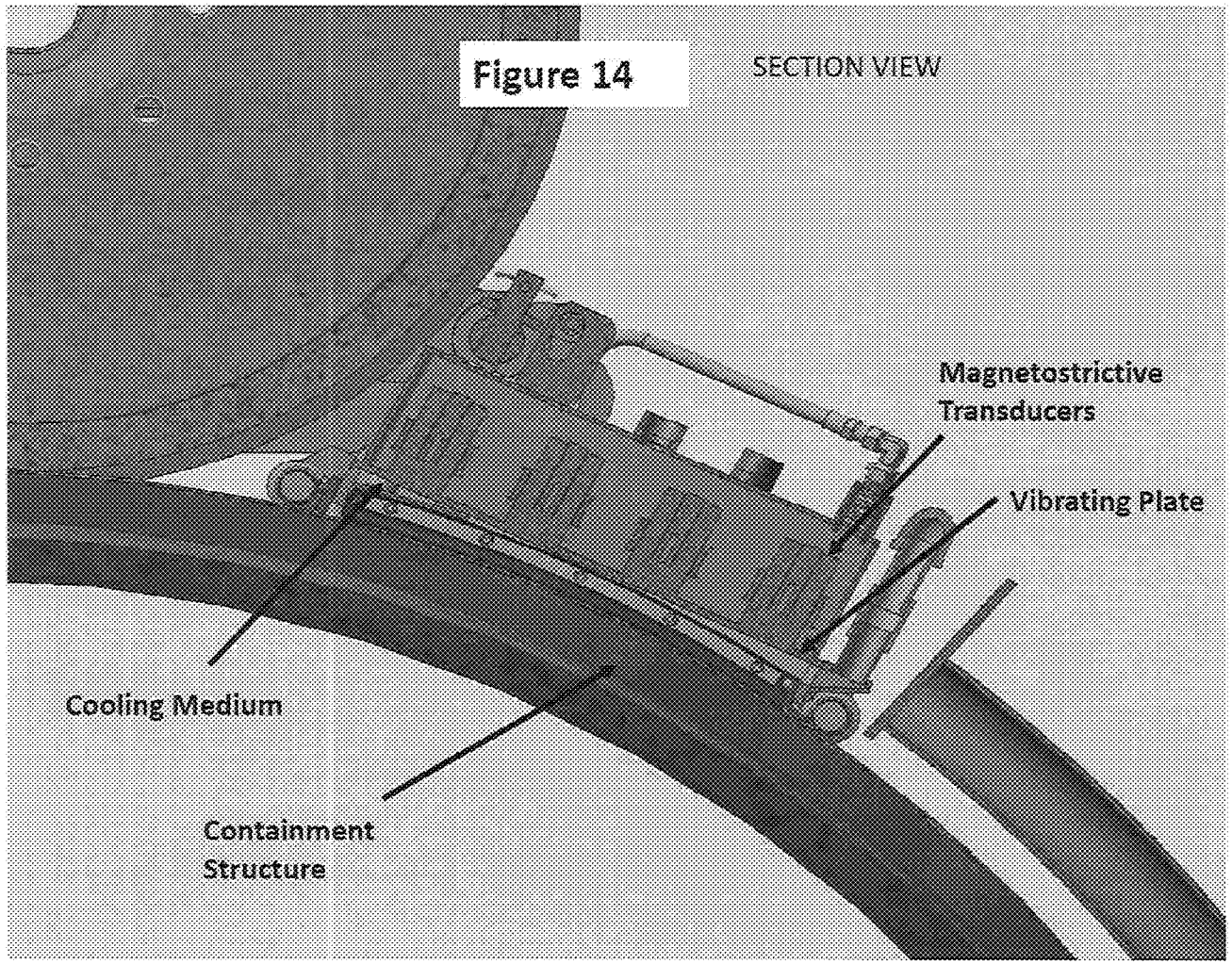
FIG. 14 is a sectional schematic of the magnetostrictive element of FIG. 13.

In one embodiment of the invention, the vibrational energy can be supplied by magnetostrictive transducers serving as vibrational energy source 40. In one embodiment, a magnetostrictive transducer serving as vibrational energy source 40 has the same placement that is utilized with the piezoelectric transducer unit of FIG. 2, with the only difference being the ultrasonic source driving the surface vibrating at the ultrasonic frequency is at least one magnetostrictive transducer instead of at least one piezoelectric element. FIG. 13 depicts a casting wheel configuration according to one embodiment of the invention utilizing for the at least one ultrasonic vibrational energy source a magnetostrictive element 40*a*. In this embodiment of the invention, the magnetostrictive transducer(s) 40*a* vibrates a probe (not shown in the side view of FIG. 13) coupled to the cooling medium at a frequency for example of 30 kHz, although other frequencies can be used as described below. In another embodiment of the invention, the magnetostrictive transducer 40*a* vibrates a bottom plate 40*b* shown in the FIG. 14 sectional schematic inside molten metal processing device 34 with the bottom plate 40*b* being coupled to the cooling medium (shown in FIG. 14).

Magnetostrictive transducers are typically composed of a large number of material plates that will expand and contract once an electromagnetic field is applied. More specifically, magnetostrictive transducers suitable for the present invention can include in one embodiment a large number of nickel (or other magnetostrictive material) plates or laminations arranged in parallel with one edge of each laminate attached to the bottom of a process container or other surface to be vibrated. A coil of wire is placed around the magnetostrictive material to provide the magnetic field. For example, when a flow of electrical current is supplied through the coil of wire, a magnetic field is created. This magnetic field causes the magnetostrictive material to contract or elongate, thereby introducing a sound wave into a fluid in contact with the expanding and contracting magnetostrictive material. Typical ultrasonic frequencies from magnetostrictive transducers suitable for the invention range from 20 to 200 kHz. Higher or lower frequencies can be used depending on the natural frequency of the magnetostrictive element.

For magnetostrictive transducers, nickel is one of the most commonly used materials. When a voltage is applied to the transducer, the nickel material expands and contracts at ultrasonic frequencies. In one embodiment of the invention, the nickel plates are directly silver brazed to a stainless steel plate. With reference to FIG. 2, the stainless steel plate of the magnetostrictive transducer is the surface that is vibrating at ultrasonic frequencies and is the surface (or probe) coupled directly to the cooling medium flowing through molten metal processing device 34. The cavitations that are produced in the cooling medium via the plate vibrating at ultrasonics frequencies, then impact the band 36 which is in contact with the molten aluminum in the containment structure 32.

U.S. Pat. No. 7,462,960 (the entire contents of which are incorporated herein by reference) describes an ultrasonic transducer driver having a giant magnetostrictive element. Accordingly, in one embodiment of the invention, the magnetostrictive element can be made from rare-earth-alloy-based materials such as Terfenol-D and its composites which have an unusually large magnetostrictive effect as compared with early transition metals, such as iron (Fe), cobalt (Co) and nickel (Ni). Alternatively, the magnetostrictive element in one embodiment of the invention can be made from iron (Fe), cobalt (Co) and nickel (Ni).

Alternatively, the magnetostrictive element in one embodiment of the invention can be made from one or more of the following alloys iron and terbium; iron and praseodymium; iron, terbium and praseodymium; iron and dysprosium; iron, terbium and dysprosium; iron, praseodymium and dysprodium; iron, terbium, praseodymium and dysprosium; iron, and erbium; iron and samarium; iron, erbium and samarium; iron, samarium and dysprosium; iron and holmium; iron, samarium and holmium; or mixture thereof.

U.S. Pat. No. 4,158,368 (the entire contents of which are incorporated herein by reference) describes a magnetostrictive transducer. As described therein and suitable for the present invention, the magnetostrictive transducer can include a plunger of a material exhibiting negative magnetostriction disposed within a housing. U.S. Pat. No. 5,588,466 (the entire contents of which are incorporated herein by reference) describes a magnetostrictive transducer. As described therein and suitable for the present invention, a magnetostrictive layer is applied to a flexible element, for example, a flexible beam. The flexible element is deflected by an external magnetic field. As described in the '466 patent and suitable for the present invention, a thin magnetostrictive layer can be used for the magnetostrictive element which consists of $Tb(1-x)\ Dy(x)\ Fe_2$. U.S. Pat. No. 4,599,591 (the entire contents of which are incorporated herein by reference) describes a magnetostrictive transducer. As described therein and suitable for the present invention, the magnetostrictive transducer can utilize a magnetostrictive material and a plurality of windings connected to multiple current sources having a phase relationship so as to establish a rotating magnetic induction vector within the magnetostrictive material. U.S. Pat. No. 4,986,808 (the entire contents of which are incorporated herein by reference) describes a magnetostrictive transducer. As described therein and suitable for the present invention, the magnetostrictive transducer can include a plurality of elongated strips of magnetostrictive material, each strip having a proximal end, a distal end and a substantially V-shaped cross section with each arm of the V is formed by a longitudinal length of the strip and each strip being attached to an adjacent strip at both the proximal end and the distal end to form and integral substantially rigid column having a central axis with fins extending radially relative to this axis.

Figure 3:
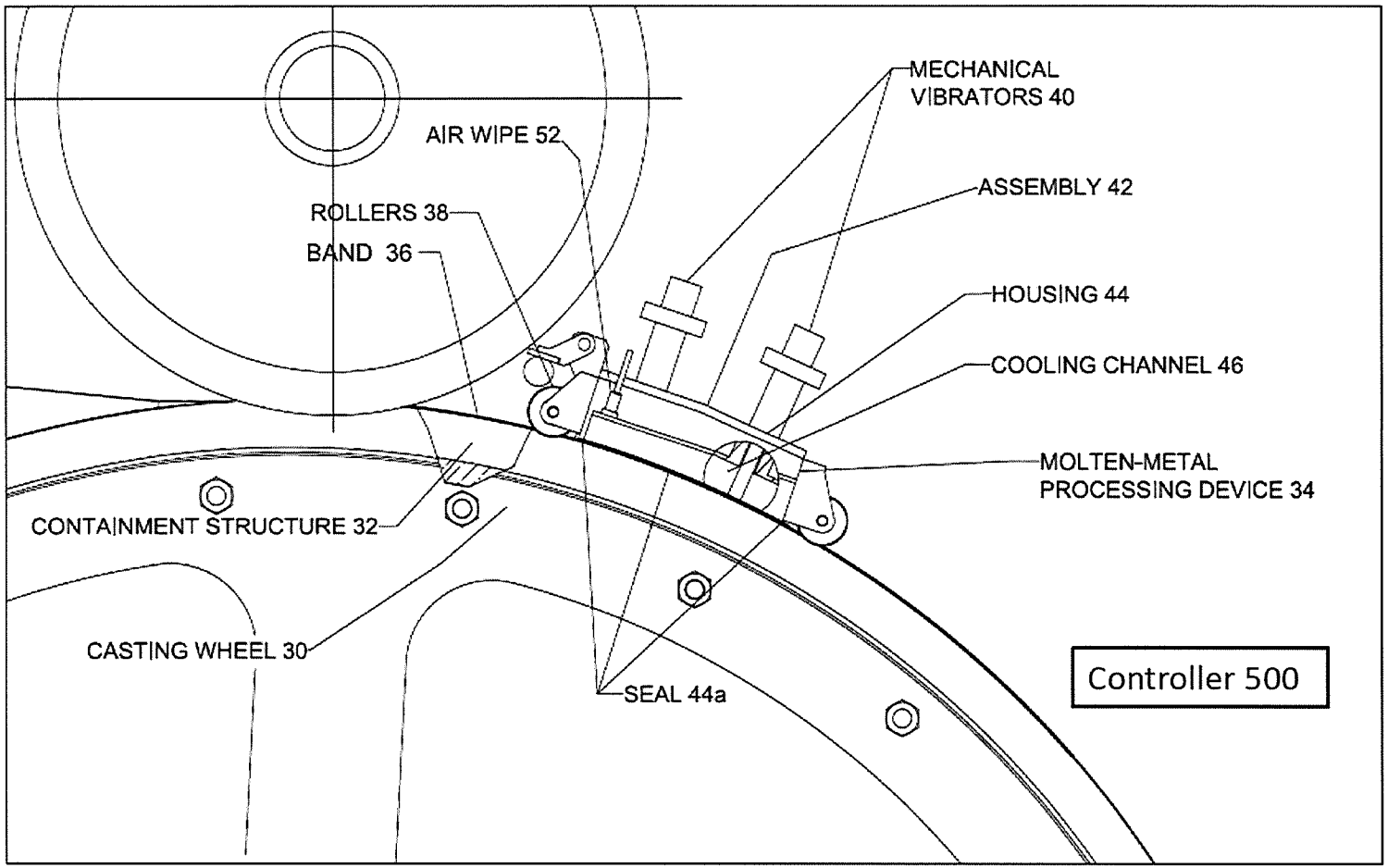
FIG. 3 is a schematic of a casting wheel configuration according to one embodiment of the invention specifically utilizing at least one mechanically-driven vibrational energy source.

FIG. 3 is a schematic of another embodiment of the invention showing a mechanical vibrational configuration for supplying lower frequency vibrational energy to molten metal in a channel of casting wheel 30. In one embodiment of the invention, the vibrational energy is from a mechanical vibration generated by a transducer or other mechanical agitator. As is known from the art, a vibrator is a mechanical device which generates vibrations. A vibration is often generated by an electric motor with an unbalanced mass on its driveshaft. Some mechanical vibrators consist of an electromagnetic drive and a stirrer shaft which agitates by vertical reciprocating motion. In one embodiment of the invention, the vibrational energy is supplied from a vibrator (or other component) that is capable of using mechanical energy to create vibrational frequencies up to but not limited to 20 kHz, and preferably in a range from 5-10 kHz.

Regardless of the vibrational mechanism, attaching a vibrator (a piezoelectric transducer, a magnetostrictive transducer, or mechanically-driven vibrator) to housing 44 means that vibrational energy can be transferred to the molten metal in the channel under assembly 42.

Mechanical vibrators useful for the invention can operate from 8,000 to 15,000 vibrations per minute, although higher and lower frequencies can be used. In one embodiment of the invention, the vibrational mechanism is configured to vibrate between 565 and 5,000 vibrations per second. In one embodiment of the invention, the vibrational mechanism is configured to vibrate at even lower frequencies down to a fraction of a vibration every second up to the 565 vibrations per second. Ranges of mechanically driven vibrations suitable for the invention include e.g., 6,000 to 9,000 vibrations per minute, 8,000 to 10,000 vibrations per minute, 10,000 to 12,000 vibrations per minute, 12,000 to 15,000 vibrations per minute, and 15,000 to 25,000 vibrations per minute. Ranges of mechanically driven vibrations suitable for the invention from the literature reports include for example of ranges from 133 to 250 Hz, 200 Hz to 283 Hz (12,000 to 17,000 vibrations per minute), and 4 to 250 Hz. Furthermore, a wide variety of mechanically driven oscillations can be impressed in the casting wheel 30 or the housing 44 by a simple hammer or plunger device driven periodically to strike the casting wheel 30 or the housing 44. In general, the mechanical vibrations can range up to 10 kHz. Accordingly, ranges suitable for the mechanical vibrations used in the invention include: 0 to 10 KHz, 10 Hz to 4000 Hz, 20 Hz to 2000 Hz, 40 Hz to 1000 Hz, 100 Hz to 500 Hz, and intermediate and combined ranges thereof, including a preferred range of 565 to 5,000 Hz.

While described above with respect to ultrasonic and mechanically driven embodiments, the invention is not so limited to one or the other of these ranges, but can be used for a broad spectrum of vibrational energy up to 400 KHz including single frequency and multiple frequency sources. Additionally, a combination of sources (ultrasonic and mechanically driven sources, or different ultrasonic sources, or different mechanically driven sources or acoustic energy sources to be described below) can be used.

As shown in FIG. 3, casting mill 2 includes a casting wheel 30 having a containment structure 32 (e.g., a trough or channel) in the casting wheel 30 in which molten metal is poured and a molten metal processing device 34. Band 36 (e.g., a steel band) confines the molten metal to the containment structure 32 (i.e., the channel). As above, rollers 38 allow the molten metal processing device 34 to remain stationary as the molten metal 1) solidifies in the channel of the casting wheel and 2) is conveyed away from the molten metal processing device 34.

A cooling channel 46 transports a cooling medium therethrough. As before, an air wipe 52 directs air (as a safety precaution) such that any water leaking from the cooling channel is directed along a direction away from the casting source of the molten metal. As before, a rolling device (e.g., rollers 38) guides the molten metal processing device 34 with respect to the rotating casting wheel 30. The cooling medium provides cooling to the molten metal and the at least one vibrational energy source 40 (shown in FIG. 3 as a mechanical vibrator 40).

As molten metal passes under the metal band 36 under mechanical vibrator 40, mechanically-driven vibrational energy is supplied to the molten metal as the metal begins to cool and solidify. The mechanically-driven vibrational energy in one embodiment permits the formation of multiple small seeds, thereby producing a fine grain metal product.

In one embodiment of the invention, disposed coupled to the cooling channels 46 is at least one vibrator 40 which in the case of mechanical vibrators provides mechanically-driven vibrational energy through the cooling medium as well as through the assembly 42 and the band 36 into the liquid metal. In one embodiment of the invention, the head of a mechanical vibrator is inserted into cooling channel 46 to be in conduct with a liquid cooling medium. In one embodiment of the invention, more than one mechanical vibrator head or an array of mechanical vibrator heads can be inserted into cooling channel 46 to be in contact with a liquid cooling medium. In one embodiment of the invention, the mechanical vibrator head can be attached to a wall of assembly 42.

While not bound to any particular theory, a relatively small amount of undercooling (e.g., less than 10° C.) at the bottom of the channel of casting wheel 30 results in a layer of small nuclei of purer aluminum (or other metal or alloy) being formed. The mechanically-driven vibrations create these nuclei which then are used as nucleating agents during solidification resulting in a uniform grain structure. Accordingly, in one embodiment of the invention, the cooling method employed ensures that a small amount of undercooling at the bottom of the channel results in a layer of small nuclei of the material being processed. The mechanically-driven vibrations from the bottom of the channel disperse these nuclei and/or can serve to break up dendrites that form in the undercooled layer. These nuclei and fragments of dendrites are then used to form equiaxed grains in the mold during solidification resulting in a uniform grain structure.

In other words, in one embodiment of the invention, mechanically-driven vibrations transmitted into the liquid metal create nucleation sites in the metals or metallic alloys to refine the grain size. As above, the channel of the casting wheel 30 can be a refractory metal or other high temperature material such as copper, irons and steels, niobium, niobium and molybdenum, tantalum, tungsten, and rhenium, and alloys thereof including one or more elements such as silicon, oxygen, or nitrogen which can extend the melting points of these materials.

Figure 3A:
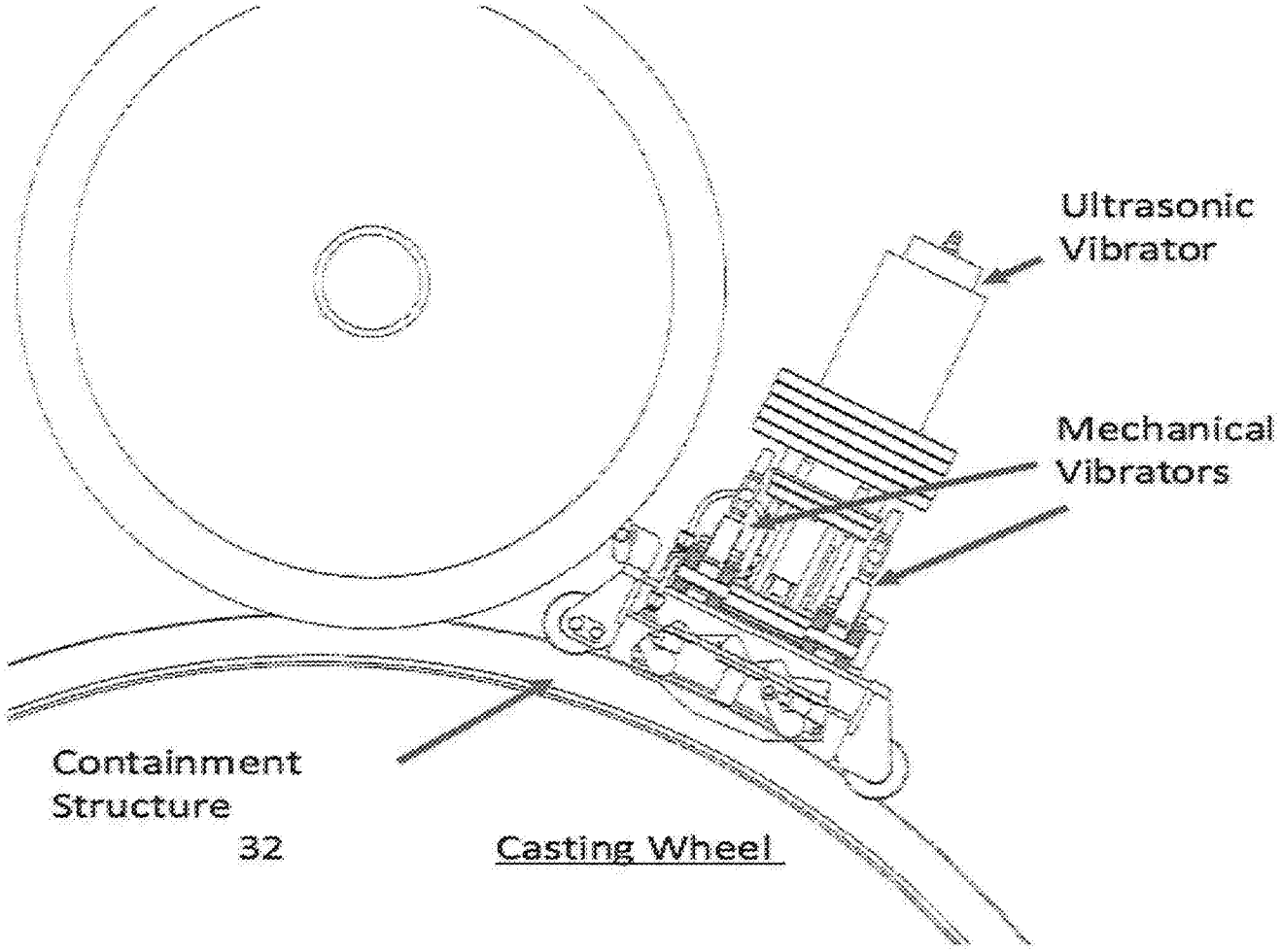
FIG. 3A is a schematic of a casting wheel hybrid configuration according to one embodiment of the invention utilizing both at least one ultrasonic vibrational energy source and at least one mechanically-driven vibrational energy source.

FIG. 3A is a schematic of a casting wheel hybrid configuration according to one embodiment of the invention utilizing both at least one ultrasonic vibrational energy source and at least one mechanically-driven vibrational energy source (e.g., a mechanically-driven vibrator). The elements shown in common with those of FIG. 3 are similar elements performing similar functions as noted above. For example, the containment structure 32 (e.g., a trough or channel) noted in FIG. 3A is in the depicted casting wheel in which the molten metal is poured. As above, a band (not shown in FIG. 3A) confines the molten metal to the containment structure 32. Here, in this embodiment of the invention, both an ultrasonic vibrational energy source(s) and a mechanically-driven vibrational energy source(s) are selectively activatable and can be driven separately or in conjunction with each other to provide vibrations which, upon being transmitted into the liquid metal, create nucleation sites in the metals or metallic alloys to refine the grain size. In various embodiments of the invention, different combinations of ultrasonic vibrational energy source(s) and mechanically-driven vibrational energy source(s) can be arranged and utilized.

Aspects of the Invention

In one aspect of the invention, the vibrational energy (from low frequency mechanically-driven vibrators in the 8,000 to 15,000 vibrations per minute range or up to 10 KHz and/or ultrasonic frequencies in the range of 5 to 400 kHz) can be applied to a molten metal containment during cooling. In one aspect of the invention, the vibrational energy can be applied at multiple distinct frequencies. In one aspect of the invention, the vibrational energy can be applied to a variety of metal alloys including, but not limited to those metals and alloys listed below: Aluminum, Copper, Gold, Iron, Nickel, Platinum, Silver, Zinc, Magnesium, Titanium, Niobium, Tungsten, Manganese, Iron, and alloys and combinations thereof; metals alloys including—Brass (Copper/Zinc), Bronze (Copper/Tin), Steel (iron/Carbon), Chromalloy (chromium), Stainless Steel (steel/Chromium), Tool Steel (Carbon/Tungsten/Manganese, Titanium (Iron/aluminum) and standardized grades of Aluminum alloys including—1100, 1350, 2024, 2224, 5052, 5154, 5356. 5183, 6101, 6201, 6061, 6053, 7050, 7075, 8XXX series; copper alloys including, bronze (noted above) and copper alloyed with a combination of Zinc, Tin, Aluminum, Silicon, Nickel, Silver; Magnesium alloyed with—Aluminum, Zinc, Manganese, Silicon, Copper, Nickel, Zirconium, Beryllium, Calcium, Cerium, Neodymium, Strontium, Tin, Yttrium, rare earths; Iron and Iron alloyed with Chromium, Carbon, Silicon Chromium, Nickel, Potassium, Plutonium, Zinc, Zirconium, Titanium, Lead, Magnesium, Tin, Scandium; and other alloys and combinations thereof.

In one aspect of the invention, the vibrational energy (from low frequency mechanically-driven vibrators in the 8,000 to 15,000 vibrations per minute range or up to 10 KHz and/or ultrasonic frequencies in the range of 5 to 400 kHz) is coupled through a liquid medium in contact with the band into the solidifying metal under the molten metal processing device 34. In one aspect of the invention, the vibrational energy is mechanically coupled between 565 and 5,000 Hz. In one aspect of the invention, the vibrational energy is mechanically driven at even lower frequencies down to a fraction of a vibration every second up to the 565 vibrations per second. In one aspect of the invention, the vibrational energy is ultrasonically driven at frequencies from the 5 kHz range to 400 kHz. In one aspect of the invention, the vibrational energy is coupled through the housing 44 containing the vibrational energy source 40. The housing 44 connects to the other structural elements such as band 36 or rollers 38 which are in contact with either the walls of the channel or directly with the molten metal. In one aspect of the invention, this mechanical coupling transmits the vibrational energy from the vibrational energy source into the molten metal as the metal cools.

In one aspect, the cooling medium can be a liquid medium such as water. In one aspect, the cooling medium can be a gaseous medium such as one of compressed air or nitrogen. In one aspect, the cooling medium can be a phase change material. It is preferred that the cooling medium be provided at a sufficient rate to undercool the metal adjacent the band 36 (less than 5 to 10° C. above the liquidus temperature of the alloy or even lower than the liquidus temperature).

In one aspect of the invention, equiaxed grains within the cast product are obtained without the necessity of adding impurity particles, such as titanium boride, into the metal or metallic alloy to increase the number of grains and improve uniform heterogeneous solidification. Instead of using the nucleating agents, in one aspect of the invention, vibrational energy can be used to create nucleating sites.

During operation, molten metal at a temperature substantially higher than the liquidus temperature of the alloy flows by gravity into the channel of castling wheel 30 and passes under the molten metal processing device 34 where it is exposed to vibrational energy (i.e., ultrasonic or mechanically-driven vibrations). The temperature of the molten metal flowing into the channel of the casting depends on the type of alloy chose, the rate of pour, the size of the casting wheel channel, among others. For aluminum alloys, the casting temperature can range from 1220 F to 1350 F, with preferred ranges in between such as for example, 1220 to 1300 F, 1220 to 1280 F, 1220 to 1270 F, 1220 to 1340 F, 1240 to 1320 F, 1250 to 1300 F, 1260 to 1310 F, 1270 to 1320 F, 1320 to 1330 F, with overlapping and intermediate ranges and variances of +/−10 degrees F. also suitable. The channel of casting wheel 30 is cooled to ensure that the molten metal in the channel is close to the sub-liquidus temperature (e.g., less than 5 to 10° C. above the liquidus temperature of the alloy or even lower than the liquidus temperature, although the pouring temperature can be much higher than 10° C.). During operation, the atmosphere about the molten metal may be controlled by way of a shroud (not shown) which is filled or purged for example with an inert gas such as Ar, He, or nitrogen. The molten metal on the casting wheel 30 is typically in a state of thermal arrest in which the molten metal is converting from a liquid to a solid.

As a result of the undercooling close to the sub-liquidus temperature, solidification rates are not slow enough to allow equilibrium through the solidus-liquidus interface, which in turn results in variations in the compositions across the cast bar. The non-uniformity of chemical composition results in segregation. In addition, the amount of segregation is directly related to the diffusion coefficients of the various elements in the molten metal as well as the heat transfer rates. Another type of segregation is the place where constituents with the lower melting points will freeze first.

In the ultrasonic or mechanically-driven vibration embodiments of the invention, the vibrational energy agitates the molten metal as it cools. In this embodiment, the vibrational energy is imparted with an energy which agitates and effectively stirs the molten metal. In one embodiment of the invention, the mechanically-driven vibrational energy serves to continuously stir the molten metal as its cools. In various casting alloy processes, it is desirable to have high concentrations of silicon into an aluminum alloy. However, at higher silicon concentrations, silicon precipitates can form. By "remixing" these precipitates back into the molten state, elemental silicon may go at least partially back into solution. Alternatively, even if the precipitates remain, the mixing will not result in the silicon precipitates being segregated, thereby causing more abrasive wear on the downstream metal die and rollers.

In various metal alloy systems, the same kind of effect occurs where one component of the alloy (typically the higher melting point component) precipitates in a pure form in effect "contaminating" the alloy with particles of the pure component. In general, when casting an alloy, segregation occurs, whereby the concentration of solute is not constant throughout the casting. This can be caused by a variety of processes. Microsegregation, which occurs over distances comparable to the size of the dendrite arm spacing, is believed to be a result of the first solid formed being of a lower concentration than the final equilibrium concentration, resulting in partitioning of the excess solute into the liquid, so that solid formed later has a higher concentration. Macrosegregation occurs over similar distances to the size of the casting. This can be caused by a number of complex processes involving shrinkage effects as the casting solidifies, and a variation in the density of the liquid as solute is partitioned. It is desirable to prevent segregation during casting, to give a solid billet that has uniform properties throughout.

Accordingly, some alloys which would benefit from the vibrational energy treatment of the invention include those alloys noted above.

Other Configurations

The present invention is not limited to the application of use of vibrational energy merely to the channel structures described above. In general, the vibrational energy (from low frequency mechanically-driven vibrators in the range up to 10 KHz and/or ultrasonic frequencies in the range of 5 to 400 kHz) can induce nucleation at points in the casting process where the molten metal is beginning to cool from the molten state and enter the solid state (i.e., the thermal arrest state). Viewed differently, the invention, in various embodiments, combines vibrational energy from a wide variety of sources with thermal management such that the molten metal adjacent to the cooling surface is close to the liquidus temperature of the alloy. In these embodiments, the temperature of the molten metal in the channel or against the band 36 of casting wheel 30 is low enough to induce nucleation and crystal growth (dendrite formation) while the vibrational energy creates nuclei and/or breaks up dendrites that may form on the surface of the channel in casting wheel 30.

In one embodiment of the invention, beneficial aspects associated with the casting process can be had without the vibrational energy sources being energized, or being energized continuously. In one embodiment of the invention, the vibrational energy sources may be energized during programmed on/off cycles with latitude as to the duty cycle on percentages ranging from 0 to 100%, 10-50%, 50-90%, 40 to 60%, 45 to 55% and all intermediate ranges in between through control of the power to the vibrational energy sources.

In another embodiment of the invention, vibration energy (ultrasonic or mechanically driven) is directly injected into the molten aluminum cast in the casting wheel prior to band 36 contacting the molten metal. The direct application of vibrational energy causes alternating pressure in the melt. The direct application of ultrasonic energy as the vibrational energy to the molten metal can cause cavitation in the molten melt.

While not bound to any particular theory, cavitation consists of the formation of tiny discontinuities or cavities in liquids, followed by their growth, pulsation, and collapse. Cavities appear as a result of the tensile stress produced by an acoustic wave in the rarefaction phase. If the tensile stress (or negative pressure) persists after the cavity has been formed, the cavity will expand to several times the initial size. During cavitation in an ultrasonic field, many cavities appear simultaneously at distances less than the ultrasonic wavelength. In this case, the cavity bubbles retain their spherical form. The subsequent behavior of the cavitation bubbles is highly variable: a small fraction of the bubbles coalesces to form large bubbles, but almost all are collapsed by an acoustic wave in the compression phase. During compression, some of these cavities may collapse due to compressive stresses. Thus, when these cavitations collapse, high shock waves occur in the melt. Accordingly, in one embodiment of the invention, vibrational energy induced shock waves serve to break up the dendrites and other growing nuclei, thus generating new nuclei, which in turn results in an equiaxed grain structure. In addition, in another embodiment of the invention, continuous ultrasonic vibration can effectively homogenize the formed nuclei further assisting in an equiaxed structure. In another embodiment of the invention, discontinuous ultrasonic or mechanically driven vibrations can effectively homogenize the formed nuclei further assisting in an equiaxed structure.

Figure 4:
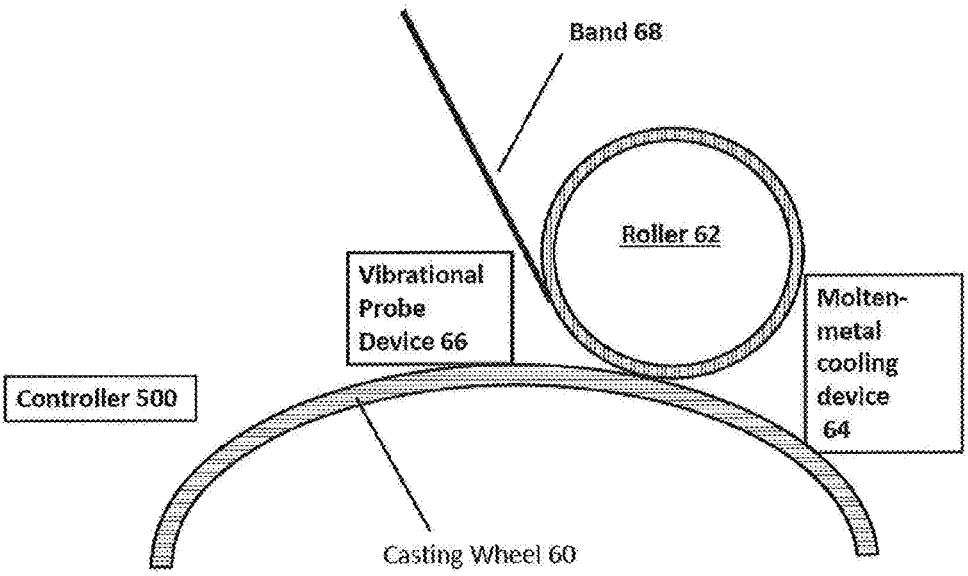
FIG. 4 is a schematic of a casting wheel configuration according to one embodiment of the invention showing a vibrational probe device coupled directly to the molten metal cast in the casting wheel.

FIG. 4 is a schematic of a casting wheel configuration according to one embodiment of the invention specifically with a vibrational probe device 66 having a probe (not shown) inserted directly to the molten metal cast in a casting wheel 60. The probe would be of a construction similar to that known in the art for ultrasonic degassing. FIG. 4 depicts a roller 62 pressing band 68 onto a rim of the casting wheel 60. The vibrational probe device 66 couples vibrational energy (ultrasonic or mechanically driven energy) directly or indirectly into molten metal cast into a channel (not shown) of the casting wheel 60. As the casting wheel 60 rotates counterclockwise, the molten metal transits under roller 62 and comes in contact with optional molten metal cooling device 64. This device 64 can be similar to the assembly 42 of FIGS. 2 and 3, but without the vibrators 40. This device 64 can be similar to the molten metal processing device 34 of FIG. 3, but without the mechanical vibrators 40.

In this embodiment, as shown in FIG. 4, a molten metal processing device for a casting mill utilizes at least one vibrational energy source (i.e., vibrational probe device 66) which supplies vibrational energy by a probe inserted into molten metal cast in the casting wheel (preferably but not necessarily directly into molten metal cast in the casting wheel) while the molten metal in the casting wheel is cooled. A support device holds the vibrational energy source (vibrational probe device 66) in place.

In another embodiment of the invention, vibrational energy can be coupled into the molten metal while it is being cooled through an air or gas as medium by use of acoustic oscillators. Acoustic oscillators (e.g., audio amplifiers) can be used to generate and transmit acoustic waves into the molten metal. In this embodiment, the ultrasonic or mechanically-driven vibrators discussed above would be replaced with or supplemented by the acoustic oscillators. Audio amplifiers suitable for the invention would provide acoustic oscillations from 1 to 20,000 Hz. Acoustic oscillations higher or lower than this range can be used. For example, acoustic oscillations from 0.5 to 20 Hz; 10 to 500 Hz, 200 to 2,000 Hz, 1,000 to 5,000 Hz, 2,000 to 10,000 Hz, 5,000 to 14,000 Hz, and 10,000 to 16,000 Hz, 14,000 to 20,000 Hz, and 18,000 to 25,000 Hz can be used. Electroacoustic transducers can be used to generate and transmit the acoustic energy.

In one embodiment of the invention, the acoustic energy can be coupled through a gaseous medium directly into the molten metal where the acoustic energy vibrates the molten metal. In one embodiment of the invention, the acoustic energy can be coupled through a gaseous medium indirectly into the molten metal where the acoustic energy vibrates the band 36 or other support structure containing the molten metal, which in turn vibrates the molten metal.

Besides use of the present invention's vibrational energy treatment in the continuous wheel-type casting systems described above, the present invention also has utility in stationary molds and in vertical casting mills.

Figure 5:
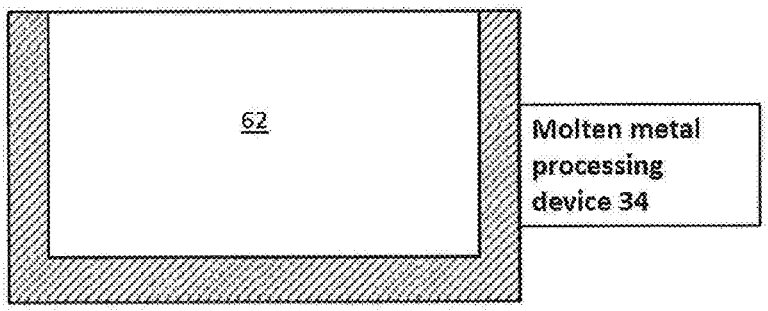
FIG. 5 is a schematic of a stationary mold utilizing the vibrational energy sources of the invention.
Figures 6A, 6B, 6C, 6D:
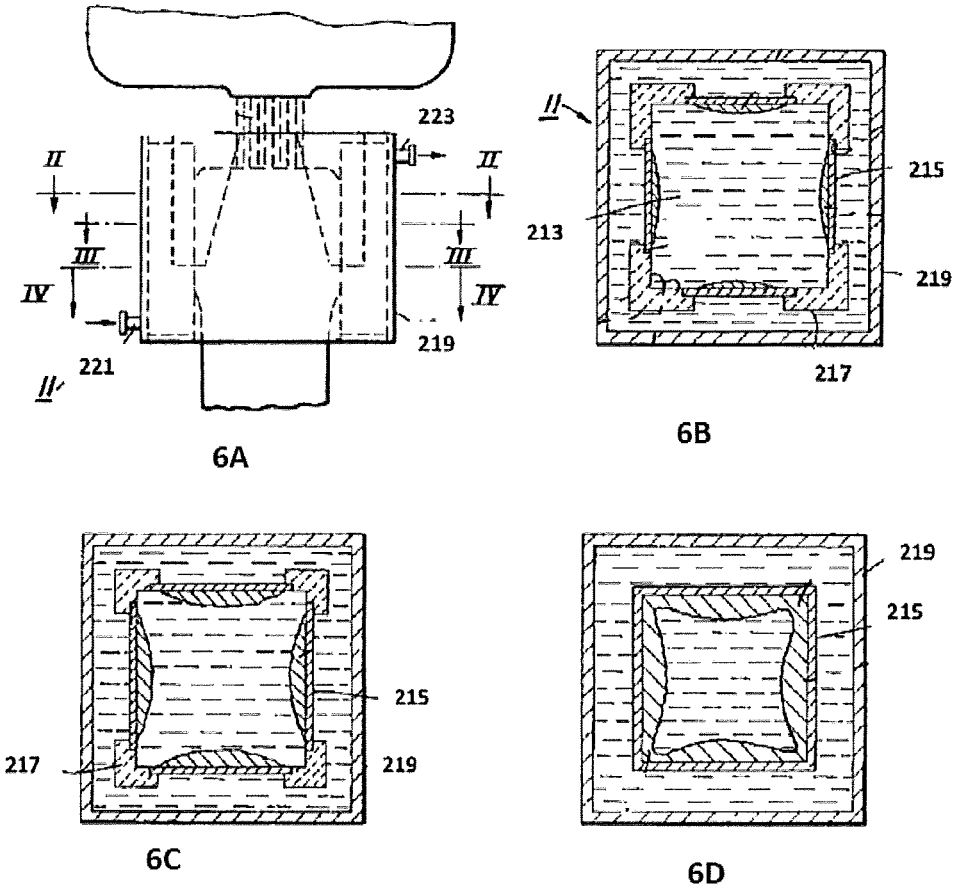
FIG. 6A is a cross sectional schematic of selected components of a vertical casting mill.
FIG. 6B is a cross sectional schematic of other components of a vertical casting mill.
FIG. 6C is a cross sectional schematic of other components of a vertical casting mill.
FIG. 6D is a cross sectional schematic of other components of a vertical casting mill.

For stationary mills, the molten metal would be poured into a stationary cast 62 such as the one shown in FIG. 5, which itself has a molten metal processing device 34 (shown schematically). In this way, vibrational energy (from low frequency mechanically-driven vibrators operating up to 10 KHz and/or ultrasonic frequencies in the range of 5 to 400 kHz) can induce nucleation at points in the stationary cast where the molten metal is beginning to cool from the molten state and enter the solid state (i.e., the thermal arrest state).

FIGS. 6A-6D depict selected components of a vertical casting mill. More details of these components and other aspects of a vertical casting mill are found in U.S. Pat. No. 3,520,352 (the entire contents of which are incorporated herein by reference). As shown in FIGS. 6A-6D, the vertical casting mill includes a molten metal casting cavity 213, which is generally square in the embodiment illustrated, but which may be round, elliptical, polygonal or any other suitable shape, and which is bounded by vertical, mutually intersecting first wall portions 215, and second or corner wall portions, 217, situated in the top portion of the mold. A fluid retentive envelope 219 surrounds the walls 215 and corner members 217 of the casting cavity in spaced apart relation thereto. Envelope 219 is adapted to receive a cooling fluid, such as water, via an inlet conduit 221, and to discharge the cooling fluid via an outlet conduit 223.

While the first wall portions 215 are preferably made of a highly thermal conductive material such as copper, the second or corner wall portions 217 are constructed of lesser thermally conductive material, such as, for example, a ceramic material. As shown in FIGS. 6A-6D, the corner wall portions 217 have a generally L-shaped or angular cross section, and the vertical edges of each corner slope downwardly and convergently toward each other. Thus, the corner member 217 terminates at some convenient level in the mold above of the discharge end of the mold which is between the transverse sections.

In operation, molten metal flows from a tundish 245 into a casting mold that reciprocates vertically and a cast strand of metal is continuously withdrawn from the mold. The molten metal is first chilled in the mold upon contacting the cooler mold walls in what may be considered as a first cooling zone. Heat is rapidly removed from the molten metal in this zone, and a skin of material is believed to form completely around a central pool of molten metal.

In one embodiment of the invention, the vibrational energy sources (vibrators 40 illustrated schematically only on FIG. 6D for the sake of simplicity) would be disposed in relation to the fluid retentive envelope 219 and preferably into the cooling medium circulating in the fluid retentive envelope 219. Vibrational energy (from low frequency mechanically-driven vibrators in the 8,000 to 15,000 vibrations per minute range and/or ultrasonic frequencies in the range of 5 to 400 kHz and/or the above-noted acoustic oscillators) would induce nucleation at points in the casting process where the molten metal is beginning to cool from the molten state and enter the solid state (i.e., the thermal arrest state) as the molten metal is converting from a liquid to a solid and as the cast strand of metal is continuously withdrawn from the metal casting cavity 213.

Figure 9:
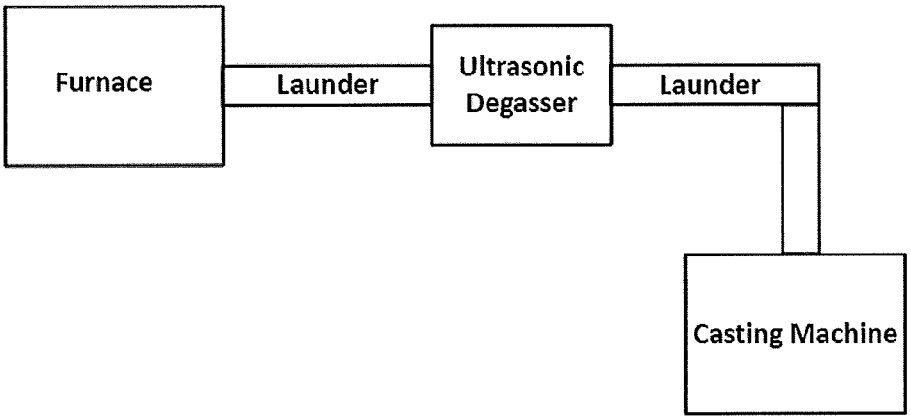
FIG. 9 is a schematic depicting an embodiment of the invention utilizing both ultrasonic degassing and ultrasonic grain refinement.

In one embodiment of the invention, the above-described ultrasonic grain refining is combined with above-noted ultrasonic degassing to remove impurities from the molten bath before the metal is cast. FIG. 9 is a schematic depicting an embodiment of the invention utilizing both ultrasonic degassing and ultrasonic grain refinement. As shown therein, a furnace is a source of molten metal. The molten metal is transported in a launder from the furnace. In one embodiment of the invention, an ultrasonic degasser is disposed in the path of launder prior to the molten metal being provided into a casting machine (e.g., casting wheel) containing an ultrasonic grain refiner (not shown). In one embodiment, grain refinement in the casting machine need not occur at ultrasonic frequencies but rather could be at one or more of the other mechanically driven frequencies discussed elsewhere.

While not limited to the following specific ultrasonic degassers, the '336 patent describes degassers which are suitable for different embodiments of the present invention. One suitable degasser would be an ultrasonic device having an ultrasonic transducer; an elongated probe comprising a first end and a second end, the first end attached to the ultrasonic transducer and the second end comprising a tip; and a purging gas delivery system, wherein the purging gas delivery system may comprise a purging gas inlet and a purging gas outlet. In some embodiments, the purging gas outlet may be within about 10 cm (or 5 cm, or 1 cm) of the tip of the elongated probe, while in other embodiments, the purging gas outlet may be at the tip of the elongated probe. In addition, the ultrasonic device may comprise multiple probe assemblies and/or multiple probes per ultrasonic transducer.

While not limited to the following specific ultrasonic degassers, the '397 patent describes degassers which are also suitable for different embodiments of the present invention. One suitable degasser would be an ultrasonic device having an ultrasonic transducer; a probe attached to the ultrasonic transducer, the probe comprising a tip; and a gas delivery system, the gas delivery system comprising a gas inlet, a gas flow path through the probe, and a gas outlet at the tip of the probe. In an embodiment, the probe may be an elongated probe comprising a first end and a second end, the first end attached to the ultrasonic transducer and the second end comprising a tip. Moreover, the probe may comprise stainless steel, titanium, niobium, a ceramic, and the like, or a combination of any of these materials. In another embodiment, the ultrasonic probe may be a unitary SIALON probe with the integrated gas delivery system therethrough. In yet another embodiment, the ultrasonic device may comprise multiple probe assemblies and/or multiple probes per ultrasonic transducer.

In one embodiment of the invention, ultrasonic degasification using for example the ultrasonic probes discussed above complements ultrasonic grain refinement. In various examples of ultrasonic degasification, a purging gas is added to the molten metal e.g., by way of the probes discussed above at a rate in a range from about 1 to about 50 L/min. By a disclosure that the flow rate is in a range from about 1 to about 50 L/min, the flow rate may be about 1, about 2, about 3, about 4, about 5, about 6, about 7, about 8, about 9, about 10, about 11, about 12, about 13, about 14, about 15, about 16, about 17, about 18, about 19, about 20, about 21, about 22, about 23, about 24, about 25, about 26, about 27, about 28, about 29, about 30, about 31, about 32, about 33, about 34, about 35, about 36, about 37, about 38, about 39, about 40, about 41, about 42, about 43, about 44, about 45, about 46, about 47, about 48, about 49, or about 50 L/min. Additionally, the flow rate may be within any range from about 1 to about 50 L/min (for example, the rate is in a range from about 2 to about 20 L/min), and this also includes any combination of ranges between about 1 and about 50 L/min. Intermediate ranges are possible. Likewise, all other ranges disclosed herein should be interpreted in a similar manner.

Embodiments of the present invention related to ultrasonic degasification and ultrasonic grain refinement may provide systems, methods, and/or devices for the ultrasonic degassing of molten metals included but not limited to, aluminum, copper, steel, zinc, magnesium, and the like, or combinations of these and other metals (e.g., alloys). The processing or casting of articles from a molten metal may require a bath containing the molten metal, and this bath of the molten metal may be maintained at elevated temperatures. For instance, molten copper may be maintained at temperatures of around 1100° C., while molten aluminum may be maintained at temperatures of around 750° C.

As used herein, the terms "bath," "molten metal bath," and the like are meant to encompass any container that might contain a molten metal, inclusive of vessel, crucible, trough, launder, furnace, ladle, and so forth. The bath and molten metal bath terms are used to encompass batch, continuous, semi-continuous, etc., operations and, for instance, where the molten metal is generally static (e.g., often associated with a crucible) and where the molten metal is generally in motion (e.g., often associated with a launder).

Many instruments or devices may be used to monitor, to test, or to modify the conditions of the molten metal in the bath, as well as for the final production or casting of the desired metal article. There is a need for these instruments or devices to better withstand the elevated temperatures encountered in molten metal baths, beneficially having a longer lifetime and limited to no reactivity with the molten metal, whether the metal is (or the metal comprises) aluminum, or copper, or steel, or zinc, or magnesium, and so forth.

Furthermore, molten metals may have one or more gasses dissolved in them, and these gasses may negatively impact the final production and casting of the desired metal article, and/or the resulting physical properties of the metal article itself. For instance, the gas dissolved in the molten metal may comprise hydrogen, oxygen, nitrogen, sulfur dioxide, and the like, or combinations thereof. In some circumstances, it may be advantageous to remove the gas, or to reduce the amount of the gas in the molten metal. As an example, dissolved hydrogen may be detrimental in the casting of aluminum (or copper, or other metal or alloy) and, therefore, the properties of finished articles produced from aluminum (or copper, or other metal or alloy) may be improved by reducing the amount of entrained hydrogen in the molten bath of aluminum (or copper, or other metal or alloy). Dissolved hydrogen over 0.2 ppm, over 0.3 ppm, or over 0.5 ppm, on a mass basis, may have detrimental effects on the casting rates and the quality of resulting aluminum (or copper, or other metal or alloy) rods and other articles. Hydrogen may enter the molten aluminum (or copper, or other metal or alloy) bath by its presence in the atmosphere above the bath containing the molten aluminum (or copper, or other metal or alloy), or it may be present in aluminum (or copper, or other metal or alloy) feedstock starting material used in the molten aluminum (or copper, or other metal or alloy) bath.

Attempts to reduce the amounts of dissolved gasses in molten metal baths have not been completely successful. Often, these processes in the past involved additional and expensive equipment, as well as potentially hazardous materials. For instance, a process used in the metal casting industry to reduce the dissolved gas content of a molten metal may consist of rotors made of a material such as graphite, and these rotors may be placed within the molten metal bath. Chlorine gas additionally may be added to the molten metal bath at positions adjacent to the rotors within the molten metal bath. While chlorine gas addition may be successful in reducing, for example, the amount of dissolved hydrogen in a molten metal bath in some situations, this conventional process has noticeable drawbacks, not the least of which are cost, complexity, and the use of potentially hazardous and potentially environmentally harmful chlorine gas.

Additionally, molten metals may have impurities present in them, and these impurities may negatively impact the final production and casting of the desired metal article, and/or the resulting physical properties of the metal article itself. For instance, the impurity in the molten metal may comprise an alkali metal or other metal that is neither required nor desired to be present in the molten metal. Small percentages of certain metals are present in various metal alloys, and such metals would not be considered to be impurities. As non-limiting examples, impurities may comprise lithium, sodium, potassium, lead, and the like, or combinations thereof. Various impurities may enter a molten metal bath (aluminum, copper, or other metal or alloy) by their presence in the incoming metal feedstock starting material used in the molten metal bath.

Embodiments of this invention related to ultrasonic degasification and ultrasonic grain refinement may provide methods for reducing an amount of a dissolved gas in a molten metal bath or, in alternative language, methods for degassing molten metals. One such method may comprise operating an ultrasonic device in the molten metal bath, and introducing a purging gas into the molten metal bath in close proximity to the ultrasonic device. The dissolved gas may be or may comprise oxygen, hydrogen, sulfur dioxide, and the like, or combinations thereof. For example, the dissolved gas may be or may comprise hydrogen. The molten metal bath may comprise aluminum, copper, zinc, steel, magnesium, and the like, or mixtures and/or combinations thereof (e.g., including various alloys of aluminum, copper, zinc, steel, magnesium, etc.). In some embodiments related to ultrasonic degasification and ultrasonic grain refinement, the molten metal bath may comprise aluminum, while in other embodiments, the molten metal bath may comprise copper. Accordingly, the molten metal in the bath may be aluminum or, alternatively, the molten metal may be copper.

Moreover, embodiments of this invention may provide methods for reducing an amount of an impurity present in a molten metal bath or, in alternative language, methods for removing impurities. One such method related to ultrasonic degasification and ultrasonic grain refinement may comprise operating an ultrasonic device in the molten metal bath, and introducing a purging gas into the molten metal bath in close proximity to the ultrasonic device. The impurity may be or may comprise lithium, sodium, potassium, lead, and the like, or combinations thereof. For example, the impurity may be or may comprise lithium or, alternatively, sodium. The molten metal bath may comprise aluminum, copper, zinc, steel, magnesium, and the like, or mixtures and/or combinations thereof (e.g., including various alloys of aluminum, copper, zinc, steel, magnesium, etc.). In some embodiments, the molten metal bath may comprise aluminum, while in other embodiments, the molten metal bath may comprise copper. Accordingly, the molten metal in the bath may be aluminum or, alternatively, the molten metal may be copper.

The purging gas related to ultrasonic degasification and ultrasonic grain refinement employed in the methods of degassing and/or methods of removing impurities disclosed herein may comprise one or more of nitrogen, helium, neon, argon, krypton, and/or xenon, but is not limited thereto. It is contemplated that any suitable gas may be used as a purging gas, provided that the gas does not appreciably react with, or dissolve in, the specific metal(s) in the molten metal bath. Additionally, mixtures or combinations of gases may be employed. According to some embodiments disclosed herein, the purging gas may be or may comprise an inert gas; alternatively, the purging gas may be or may comprise a noble gas; alternatively, the purging gas may be or may comprise helium, neon, argon, or combinations thereof; alternatively, the purging gas may be or may comprise helium; alternatively, the purging gas may be or may comprise neon; or alternatively, the purging gas may be or may comprise argon. Additionally, Applicants contemplate that, in some embodiments, the conventional degassing technique can be used in conjunction with ultrasonic degassing processes disclosed herein. Accordingly, the purging gas may further comprise chlorine gas in some embodiments, such as the use of chlorine gas as the purging gas alone or in combination with at least one of nitrogen, helium, neon, argon, krypton, and/or xenon.

However, in other embodiments of this invention, methods related to ultrasonic degasification and ultrasonic grain refinement for degassing or for reducing an amount of a dissolved gas in a molten metal bath may be conducted in the substantial absence of chlorine gas, or with no chlorine gas present. As used herein, a substantial absence means that no more than 5% chlorine gas by weight may be used, based on the amount of purging gas used. In some embodiments, the methods disclosed herein may comprise introducing a purging gas, and this purging gas may be selected from the group consisting of nitrogen, helium, neon, argon, krypton, xenon, and combinations thereof.

The amount of the purging gas introduced into the bath of molten metal may vary depending on a number of factors. Often, the amount of the purging gas related to ultrasonic degasification and ultrasonic grain refinement introduced in a method of degassing molten metals (and/or in a method of removing impurities from molten metals) in accordance with embodiments of this invention may fall within a range from about 0.1 to about 150 standard liters/min (L/min). In some embodiments, the amount of the purging gas introduced may be in a range from about 0.5 to about 100 L/min, from about 1 to about 100 L/min, from about 1 to about 50 L/min, from about 1 to about 35 L/min, from about 1 to about 25 L/min, from about 1 to about 10 L/min, from about 1.5 to about 20 L/min, from about 2 to about 15 L/min, or from about 2 to about 10 L/min. These volumetric flow rates are in standard liters per minute, i.e., at a standard temperature (21.1° C.) and pressure (101 kPa).

In continuous or semi-continuous molten metal operations, the amount of the purging gas introduced into the bath of molten metal may vary based on the molten metal output or production rate. Accordingly, the amount of the purging gas introduced in a method of degassing molten metals (and/or in a method of removing impurities from molten metals) in accordance with such embodiments related to ultrasonic degasification and ultrasonic grain refinement may fall within a range from about 10 to about 500 mL/hr of purging gas per kg/hr of molten metal (mL purging gas/kg molten metal). In some embodiments, the ratio of the volumetric flow rate of the purging gas to the output rate of the molten metal may be in a range from about 10 to about 400 mL/kg; alternatively, from about 15 to about 300 mL/kg; alternatively, from about 20 to about 250 mL/kg; alternatively, from about 30 to about 200 mL/kg; alternatively, from about 40 to about 150 mL/kg; or alternatively, from about 50 to about 125 mL/kg. As above, the volumetric flow rate of the purging gas is at a standard temperature (21.1° C.) and pressure (101 kPa).

Methods for degassing molten metals consistent with embodiments of this invention and related to ultrasonic degasification and ultrasonic grain refinement may be effective in removing greater than about 10 weight percent of the dissolved gas present in the molten metal bath, i.e., the amount of dissolved gas in the molten metal bath may be reduced by greater than about 10 weight percent from the amount of dissolved gas present before the degassing process was employed. In some embodiments, the amount of dissolved gas present may be reduced by greater than about 15 weight percent, greater than about 20 weight percent, greater than about 25 weight percent, greater than about 35 weight percent, greater than about 50 weight percent, greater than about 75 weight percent, or greater than about 80 weight percent, from the amount of dissolved gas present before the degassing method was employed. For instance, if the dissolved gas is hydrogen, levels of hydrogen in a molten bath containing aluminum or copper greater than about 0.3 ppm or 0.4 ppm or 0.5 ppm (on a mass basis) may be detrimental and, often, the hydrogen content in the molten metal may be about 0.4 ppm, about 0.5 ppm, about 0.6 ppm, about 0.7 ppm, about 0.8 ppm, about 0.9 ppm, about 1 ppm, about 1.5 ppm, about 2 ppm, or greater than 2 ppm. It is contemplated that employing the methods disclosed in embodiments of this invention may reduce the amount of the dissolved gas in the molten metal bath to less than about 0.4 ppm; alternatively, to less than about 0.3 ppm; alternatively, to less than about 0.2 ppm; alternatively, to within a range from about 0.1 to about 0.4 ppm; alternatively, to within a range from about 0.1 to about 0.3 ppm; or alternatively, to within a range from about 0.2 to about 0.3 ppm. In these and other embodiments, the dissolved gas may be or may comprise hydrogen, and the molten metal bath may be or may comprise aluminum and/or copper.

Embodiments of this invention related to ultrasonic degasification and ultrasonic grain refinement and directed to methods of degassing (e.g., reducing the amount of a dissolved gas in bath comprising a molten metal) or to methods of removing impurities may comprise operating an ultrasonic device in the molten metal bath. The ultrasonic device may comprise an ultrasonic transducer and an elongated probe, and the probe may comprise a first end and a second end. The first end may be attached to the ultrasonic transducer and the second end may comprise a tip, and the tip of the elongated probe may comprise niobium. Specifics on illustrative and non-limiting examples of ultrasonic devices that may be employed in the processes and methods disclosed herein are described below.

As it pertains to an ultrasonic degassing process or to a process for removing impurities, the purging gas may be introduced into the molten metal bath, for instance, at a location near the ultrasonic device. In one embodiment, the purging gas may be introduced into the molten metal bath at a location near the tip of the ultrasonic device. In one embodiment, the purging gas may be introduced into the molten metal bath within about 1 meter of the tip of the ultrasonic device, such as, for example, within about 100 cm, within about 50 cm, within about 40 cm, within about 30 cm, within about 25 cm, or within about 20 cm, of the tip of the ultrasonic device. In some embodiments, the purging gas may be introduced into the molten metal bath within about 15 cm of the tip of the ultrasonic device; alternatively, within about 10 cm; alternatively, within about 8 cm; alternatively, within about 5 cm; alternatively, within about 3 cm; alternatively, within about 2 cm; or alternatively, within about 1 cm. In a particular embodiment, the purging gas may be introduced into the molten metal bath adjacent to or through the tip of the ultrasonic device.

While not intending to be bound by this theory, the use of an ultrasonic device and the incorporation of a purging gas in close proximity, results in a dramatic reduction in the amount of a dissolved gas in a bath containing molten metal. The ultrasonic energy produced by the ultrasonic device may create cavitation bubbles in the melt, into which the dissolved gas may diffuse. However, in the absence of the purging gas, many of the cavitation bubbles may collapse prior to reaching the surface of the bath of molten metal. The purging gas may lessen the amount of cavitation bubbles that collapse before reaching the surface, and/or may increase the size of the bubbles containing the dissolved gas, and/or may increase the number of bubbles in the molten metal bath, and/or may increase the rate of transport of bubbles containing dissolved gas to the surface of the molten metal bath. The ultrasonic device may create cavitation bubbles within close proximity to the tip of the ultrasonic device. For instance, for an ultrasonic device having a tip with a diameter of about 2 to 5 cm, the cavitation bubbles may be within about 15 cm, about 10 cm, about 5 cm, about 2 cm, or about 1 cm of the tip of the ultrasonic device before collapsing. If the purging gas is added at a distance that is too far from the tip of the ultrasonic device, the purging gas may not be able to diffuse into the cavitation bubbles. Hence, in embodiments related to ultrasonic degasification and ultrasonic grain refinement, the purging gas is introduced into the molten metal bath within about 25 cm or about 20 cm of the tip of the ultrasonic device, and more beneficially, within about 15 cm, within about 10 cm, within about 5 cm, within about 2 cm, or within about 1 cm, of the tip of the ultrasonic device.

Ultrasonic devices in accordance with embodiments of this invention may be in contact with molten metals such as aluminum or copper, for example, as disclosed in U.S. Patent Publication No. 2009/0224443, which is incorporated herein by reference in its entirety. In an ultrasonic device for reducing dissolved gas content (e.g., hydrogen) in a molten metal, niobium or an alloy thereof may be used as a protective barrier for the device when it is exposed to the molten metal, or as a component of the device with direct exposure to the molten metal.

Embodiments of the present invention related to ultrasonic degasification and ultrasonic grain refinement may provide systems and methods for increasing the life of components directly in contact with molten metals. For example, embodiments of the invention may use niobium to reduce degradation of materials in contact with molten metals, resulting in significant quality improvements in end products. In other words, embodiments of the invention may increase the life of or preserve materials or components in contact with molten metals by using niobium as a protective barrier. Niobium may have properties, for example its high melting point, that may help provide the aforementioned embodiments of the invention. In addition, niobium also may form a protective oxide barrier when exposed to temperatures of about 200° C. and above.

Moreover, embodiments of the invention related to ultrasonic degasification and ultrasonic grain refinement may provide systems and methods for increasing the life of components directly in contact or interfacing with molten metals. Because niobium has low reactivity with certain molten metals, using niobium may prevent a substrate material from degrading. Consequently, embodiments of the invention related to ultrasonic degasification and ultrasonic grain refinement may use niobium to reduce degradation of substrate materials resulting in significant quality improvements in end products. Accordingly, niobium in association with molten metals may combine niobium's high melting point and its low reactivity with molten metals, such as aluminum and/or copper.

In some embodiments, niobium or an alloy thereof may be used in an ultrasonic device comprising an ultrasonic transducer and an elongated probe. The elongated probe may comprise a first end and a second end, wherein the first end may be attached to the ultrasonic transducer and the second end may comprise a tip. In accordance with this embodiment, the tip of the elongated probe may comprise niobium (e.g., niobium or an alloy thereof). The ultrasonic device may be used in an ultrasonic degassing process, as discussed above. The ultrasonic transducer may generate ultrasonic waves, and the probe attached to the transducer may transmit the ultrasonic waves into a bath comprising a molten metal, such as aluminum, copper, zinc, steel, magnesium, and the like, or mixtures and/or combinations thereof (e.g., including various alloys of aluminum, copper, zinc, steel, magnesium, etc.).

In various embodiments of the invention, a combination of ultrasonic degassing and ultrasonic grain refinement is used. The use of the combination of ultrasonic degassing and ultrasonic grain refinement provides advantages both separately and in combination, as described below. While not limited to the following discussion, the following discussion provides an understanding of the unique effects accompanying a combination of the ultrasonic degassing and ultrasonic grain refinement, leading to improvement(s) in the overall quality of a cast product which would not be expected when either was used alone. These effects have been realized and by the inventors in their development of this combined ultrasonic processing.

In ultrasonic degassing, chlorine chemicals (utilized when ultrasonic degassing is not used) are eliminated from the metal casting process. When chlorine as a chemical is present in a molten metal bath, it can react and form strong chemical bonds with other foreign elements in the bath such as alkalis which might be present. When the alkalis are present, stable salts are formed in the molten metal bath, which could lead to inclusions in the cast metal product which deteriorates its electrical conductivity and mechanical properties. Without ultrasonic grain refinement, chemical grain refiners such as titanium boride are used, but these materials typically contain alkalis.

Accordingly, with ultrasonic degassing eliminating chlorine as a process element and with ultrasonic grain refinement eliminating grain refiners (a source of alkalis), the likelihood of stable salt formation and the resultant inclusion formation in the cast metal product is reduced substantially. Moreover, the elimination of these foreign elements as impurities improves the electrical conductivity of the cast metal product. Accordingly, in one embodiment of the invention, the combination of ultrasonic degassing and ultrasonic grain refinement means that the resultant cast product has superior mechanical and electrical conductivity properties, as two of the major sources of impurities are eliminated without substituting one foreign impurity for another.

Another advantage provided by the combination of ultrasonic degassing and ultrasonic grain refinement relates to the fact that both the ultrasonic degassing and ultrasonic grain refinement effectively "stir" the molten bath, homogenizing the molten material. When an alloy of the metal is being melted and then cooled to solidification, intermediate phases of the alloys can exist because of respective differences in the melting points of different alloy proportions. In one embodiment of the invention, both the ultrasonic degassing and ultrasonic grain refinement stir and mix the intermediate phases back into the molten phase.

All of these advantages permit one to obtain a product which is small-grained, having fewer impurities, fewer inclusions, better electrical conductivity, better ductility and higher tensile strength than would be expected when either ultrasonic degassing or ultrasonic grain refinement was used, or when either or both were replaced with conventional chlorine processing or chemical grain refiners were used.

Demonstration Ultrasonic Grain Refinement

The containment structures shown in FIGS. 2 and 3 and 3A have been used having a depth of 10 cm and a width of 8 cm forming a rectangular trough or channel in the casting wheel 30. The thickness of the flexible metal band was 6.35 mm. The width of the flexible metal band was 8 cm. The steel alloy used for the band was 1010 steel. An ultrasonic frequency of 20 KHz was used at a power of 120 W (per probe) being supplied to one or two transducers having the vibrating probes in contact with water in the cooling medium. A section of a copper alloy casting wheel was used as the mold. As a cooling medium, water was supplied at near room temperature and flowing at approximately 15 liters/min through channels 46.

Molten aluminum was poured at a rate of 40 kg/min producing a continuous aluminum cast showing properties consistent with an equiaxed grain structure although no grain refiners were added. Indeed, approximately 9 million pounds of aluminum rod have been cast and drawn into final dimensions for wire and cable applications using this technique.

Metal Products

In one aspect of the present invention, products including a cast metallic composition can be formed in a channel of a casting wheel or in the casting structures discussed above without the necessity of grain refiners and still having sub-millimeter grain sizes. Accordingly, the cast metallic compositions can be made with less than 5% of the compositions including the grain refiners and still obtain sub-millimeter grain sizes. The cast metallic compositions can be made with less than 2% of the compositions including the grain refiners and still obtain sub-millimeter grain sizes. The cast metallic compositions can be made with less than 1% of the compositions including the grain refiners and still obtain sub-millimeter grain sizes. In a preferred composition, the grain refiners are less than 0.5% or less than 0.2% or less than 0.1%. The cast metallic compositions can be made with the compositions including no grain refiners and still obtain sub-millimeter grain sizes.

The cast metallic compositions can have a variety of sub-millimeter grain sizes depending on a number of factors including the constituents of the "pure" or alloyed metal, the pour rates, the pour temperatures, the rate of cooling. The list of grain sizes available to the present invention includes the following. For aluminum and aluminum alloys, grain sizes range from 200 to 900 micron, or 300 to 800 micron, or 400 to 700 micron, or 500 to 600 micron. For copper and copper alloys, grain sizes range from 200 to 900 micron, or 300 to 800 micron, or 400 to 700 micron, or 500 to 600 micron. For gold, silver, or tin or alloys thereof, grain sizes range from 200 to 900 micron, or 300 to 800 micron, or 400 to 700 micron, or 500 to 600 micron. For magnesium or magnesium alloys, grain sizes range from 200 to 900 micron, or 300 to 800 micron, or 400 to 700 micron, or 500 to 600 micron. While given in ranges, the invention is capable of intermediate values as well. In one aspect of the present invention, small concentrations (less than 5%) of the grain refiners may be added to further reduce the grain size to values between 100 and 500 micron. The cast metallic compositions can include aluminum, copper, magnesium, zinc, lead, gold, silver, tin, bronze, brass, and alloys thereof.

The cast metallic compositions can be drawn or otherwise formed into bar stock, rod, stock, sheet stock, wires, billets, and pellets.

Computerized Control

Figure 7:
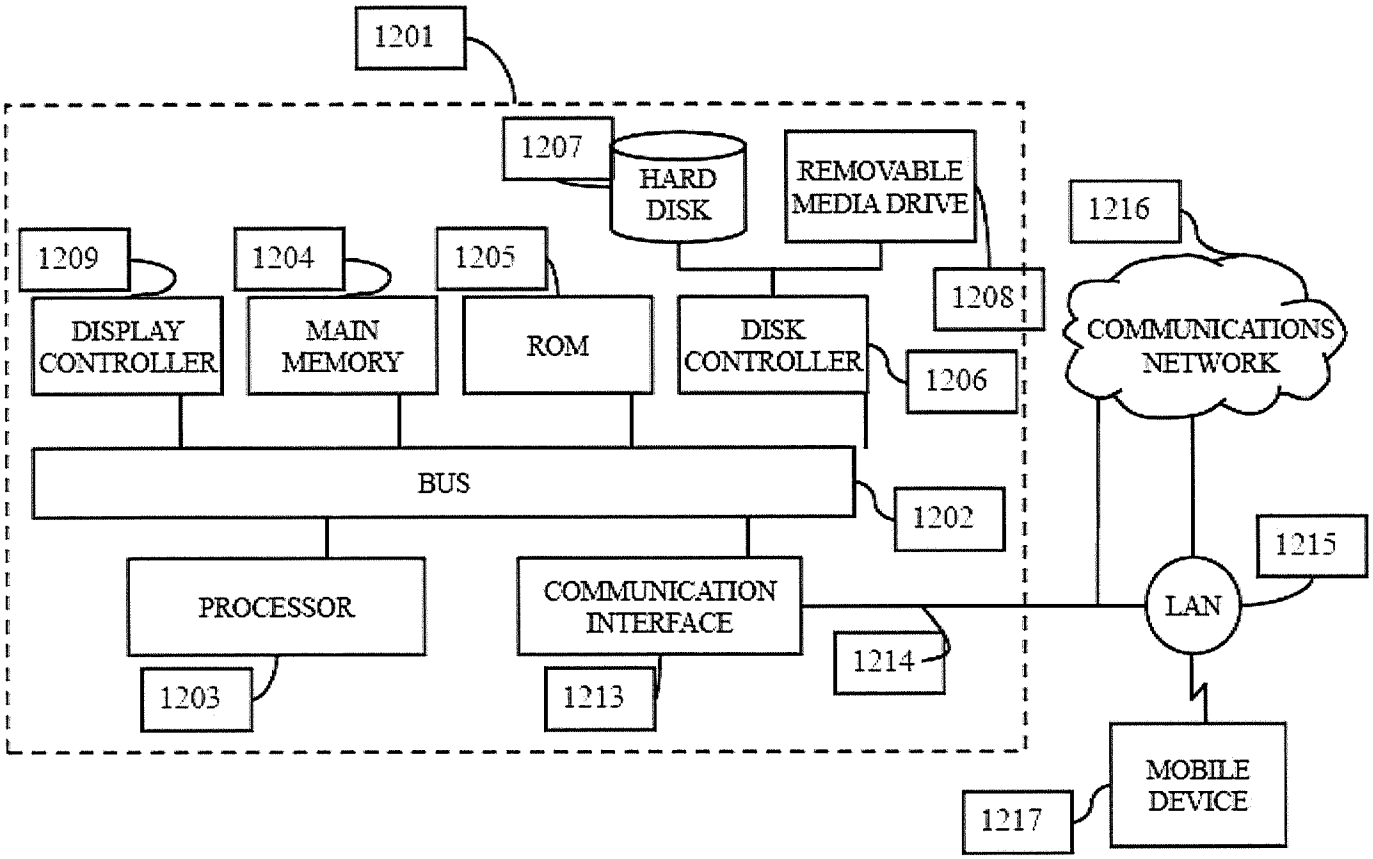
FIG. 7 is a schematic of an illustrative computer system for the controls and controllers depicted herein.

The controller 500 in FIGS. 1, 2, 3, and 4 can be implemented by way of the computer system 1201 shown in FIG. 7. The computer system 1201 may be used as the controller 500 to control the casting systems noted above or any other casting system or apparatus employing the ultrasonic treatment of the present invention. While depicted singularly in FIGS. 1, 2, 3, and 4 as one controller, controller 500 may include discrete and separate processors in communication with each other and/or dedicated to a specific control function.

Figure 8:
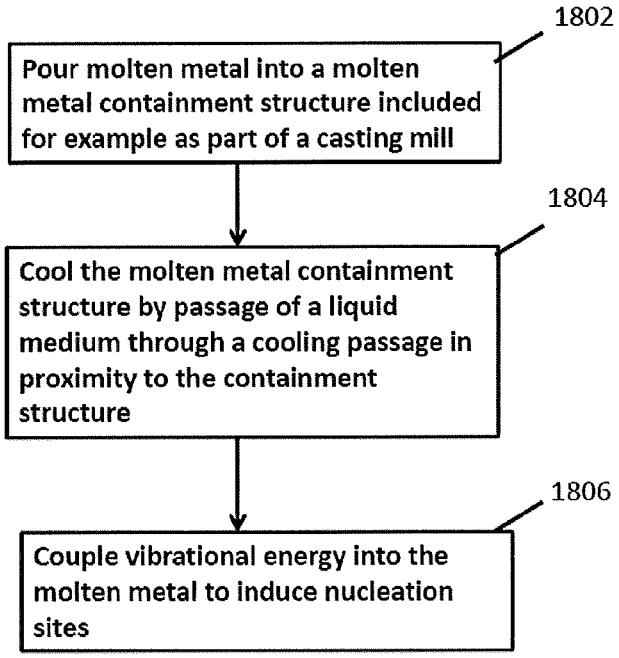
FIG. 8 is a flow chart depicting a method according to one embodiment of the invention.

In particular, the controller 500 can be programmed specifically with control algorithms carrying out the functions depicted by the flowchart in FIG. 8.

FIG. 8 depicts a flowchart whose elements can be programmed or stored in a computer readable medium or in one of the data storage devices discussed below. The flowchart of FIG. 8 depicts a method of the present invention for inducing nucleation sites in a metal product. At step element 1802, the programmed element would direct the operation of pouring molten metal, into a molten metal containment structure. At step element 1804, the programmed element would direct the operation of cooling the molten metal containment structure for example by passage of a liquid medium through a cooling channel in proximity to the molten metal containment structure. At step element 1806, the programmed element would direct the operation of coupling vibrational energy into the molten metal. In this element, the vibrational energy would have a frequency and power which induces nucleation sites in the molten metal, as discussed above.

Elements such as the molten metal temperature, pouring rate, cooling flow through the cooling channel passages, and mold cooling and elements related to the control and draw of the cast product through the mill, including control of the power and frequency of the vibrational energy sources, would be programmed with standard software languages (discussed below) to produce special purpose processors containing instructions to apply the method of the present invention for inducing nucleation sites in a metal product.

More specifically, computer system 1201 shown in FIG. 7 includes a bus 1202 or other communication mechanism for communicating information, and a processor 1203 coupled with the bus 1202 for processing the information. The computer system 1201 also includes a main memory 1204, such as a random access memory (RAM) or other dynamic storage device (e.g., dynamic RAM (DRAM), static RAM (SRAM), and synchronous DRAM (SDRAM)), coupled to the bus 1202 for storing information and instructions to be executed by processor 1203. In addition, the main memory 1204 may be used for storing temporary variables or other intermediate information during the execution of instructions by the processor 1203. The computer system 1201 further includes a read only memory (ROM) 1205 or other static storage device (e.g., programmable read only memory (PROM), erasable PROM (EPROM), and electrically erasable PROM (EEPROM)) coupled to the bus 1202 for storing static information and instructions for the processor 1203.

The computer system 1201 also includes a disk controller 1206 coupled to the bus 1202 to control one or more storage devices for storing information and instructions, such as a magnetic hard disk 1207, and a removable media drive 1208 (e.g., floppy disk drive, read-only compact disc drive, read/write compact disc drive, compact disc jukebox, tape drive, and removable magneto-optical drive). The storage devices may be added to the computer system 1201 using an appropriate device interface (e.g., small computer system interface (SCSI), integrated device electronics (IDE), enhanced-IDE (E-IDE), direct memory access (DMA), or ultra-DMA).

The computer system 1201 may also include special purpose logic devices (e.g., application specific integrated circuits (ASICs)) or configurable logic devices (e.g., simple programmable logic devices (SPLDs), complex programmable logic devices (CPLDs), and field programmable gate arrays (FPGAs)).

The computer system 1201 may also include a display controller 1209 coupled to the bus 1202 to control a display, such as a cathode ray tube (CRT) or liquid crystal display (LCD), for displaying information to a computer user. The computer system includes input devices, such as a keyboard and a pointing device, for interacting with a computer user (e.g. a user interfacing with controller 500) and providing information to the processor 1203.

The computer system 1201 performs a portion or all of the processing steps of the invention (such as for example those described in relation to providing vibrational energy to a liquid metal in a state of thermal arrest) in response to the processor 1203 executing one or more sequences of one or more instructions contained in a memory, such as the main memory 1204. Such instructions may be read into the main memory 1204 from another computer readable medium, such as a hard disk 1207 or a removable media drive 1208. One or more processors in a multi-processing arrangement may also be employed to execute the sequences of instructions contained in main memory 1204. In alternative embodiments, hard-wired circuitry may be used in place of or in combination with software instructions. Thus, embodiments are not limited to any specific combination of hardware circuitry and software.

The computer system 1201 includes at least one computer readable medium or memory for holding instructions programmed according to the teachings of the invention and for containing data structures, tables, records, or other data described herein. Examples of computer readable media are compact discs, hard disks, floppy disks, tape, magneto-optical disks, PROMs (EPROM, EEPROM, flash EPROM), DRAM, SRAM, SDRAM, or any other magnetic medium, compact discs (e.g., CD-ROM), or any other optical medium, or other physical medium, a carrier wave (described below), or any other medium from which a computer can read.

Stored on any one or on a combination of computer readable media, the invention includes software for controlling the computer system 1201, for driving a device or devices for implementing the invention, and for enabling the computer system 1201 to interact with a human user. Such software may include, but is not limited to, device drivers, operating systems, development tools, and applications software. Such computer readable media further includes the computer program product of the invention for performing all or a portion (if processing is distributed) of the processing performed in implementing the invention.

The computer code devices of the invention may be any interpretable or executable code mechanism, including but not limited to scripts, interpretable programs, dynamic link libraries (DLLs), Java classes, and complete executable programs. Moreover, parts of the processing of the invention may be distributed for better performance, reliability, and/or cost.

The term "computer readable medium" as used herein refers to any medium that participates in providing instructions to the processor 1203 for execution. A computer readable medium may take many forms, including but not limited to, non-volatile media, volatile media, and transmission media. Non-volatile media includes, for example, optical, magnetic disks, and magneto-optical disks, such as the hard disk 1207 or the removable media drive 1208. Volatile media includes dynamic memory, such as the main memory 1204. Transmission media includes coaxial cables, copper wire and fiber optics, including the wires that make up the bus 1202. Transmission media may also take the form of acoustic or light waves, such as those generated during radio wave and infrared data communications.

The computer system 1201 can also include a communication interface 1213 coupled to the bus 1202. The communication interface 1213 provides a two-way data communication coupling to a network link 1214 that is connected to, for example, a local area network (LAN) 1215, or to another communications network 1216 such as the Internet. For example, the communication interface 1213 may be a network interface card to attach to any packet switched LAN. As another example, the communication interface 1213 may be an asymmetrical digital subscriber line (ADSL) card, an integrated services digital network (ISDN) card or a modem to provide a data communication connection to a corresponding type of communications line. Wireless links may also be implemented. In any such implementation, the communication interface 1213 sends and receives electrical, electromagnetic or optical signals that carry digital data streams representing various types of information.

The network link 1214 typically provides data communication through one or more networks to other data devices. For example, the network link 1214 may provide a connection to another computer through a local network 1215 (e.g., a LAN) or through equipment operated by a service provider, which provides communication services through a communications network 1216. In one embodiment, this capability permits the invention to have multiple of the above described controllers 500 networked together for purposes such as factory wide automation or quality control. The local network 1215 and the communications network 1216 use, for example, electrical, electromagnetic, or optical signals that carry digital data streams, and the associated physical layer (e.g., CAT 5 cable, coaxial cable, optical fiber, etc). The signals through the various networks and the signals on the network link 1214 and through the communication interface 1213, which carry the digital data to and from the computer system 1201 may be implemented in baseband signals, or carrier wave based signals. The baseband signals convey the digital data as unmodulated electrical pulses that are descriptive of a stream of digital data bits, where the term "bits" is to be construed broadly to mean symbol, where each symbol conveys at least one or more information bits. The digital data may also be used to modulate a carrier wave, such as with amplitude, phase and/or frequency shift keyed signals that are propagated over a conductive media, or transmitted as electromagnetic waves through a propagation medium. Thus, the digital data may be sent as unmodulated baseband data through a "wired" communication channel and/or sent within a predetermined frequency band, different than baseband, by modulating a carrier wave. The computer system 1201 can transmit and receive data, including program code, through the network(s) 1215 and 1216, the network link 1214, and the communication interface 1213. Moreover, the network link 1214 may provide a connection through a LAN 1215 to a mobile device 1217 such as a personal digital assistant (PDA) laptop computer, or cellular telephone.

More specifically, in one embodiment of the invention, a continuous casting and rolling system (CCRS) is provided which can produce pure electrical conductor grade aluminum rod and alloy conductor grade aluminum rod coils directly from molten metal on a continuous basis. The CCRS can use one or more of the computer systems 1201 (described above) to implement control, monitoring, and data storage.

In one embodiment of the invention, to promote yield of a high quality aluminum rod, an advanced computer monitoring and data acquisition (SCADA) system monitors and/or controls the rolling mill (i.e., the CCRS). Additional variables and parameters of this system can be displayed, charted, stored and analyzed for quality control.

In one embodiment of the invention, one or more of the following post production testing processes are captured in the data acquisition system.

Eddy current flaw detectors can be used in line to continuously monitor the surface quality of the aluminum rod. Inclusions, if located near the surface of the rod, can be detected since the matrix inclusion acts as a discontinuous defect. During the casting and rolling of aluminum rod, defects in the finished product can come from anywhere in the process. Incorrect melt chemistry and/or excessive hydrogen in the metal can cause flaws during the rolling process. The eddy current system is a non-destructive test, and the control system for the CCRS can alert the operator(s) to any one of the defects described above. The eddy current system can detect surface defects, and classify the defects as small, medium or large. The eddy current results can be recorded in the SCADA system and tracked to the lot of aluminum (or other metal being processed) and when it was produced.

Once the rod is coiled at the end of the process the bulk mechanical and electrical properties of cast aluminum can be measured and recorded in the SCADA system. Product quality tests include: tensile, elongation, and conductivity. The tensile strength is a measure of the strength of the materials and is the maximum force the material can withstand under tension before breaking. The elongation values are a measure of the ductility of the material. Conductivity measurements are generally reported as a percentage of the "international annealed copper standard" (IACS). These product quality metrics can be recorded in the SCADA system and tracked to the lot of aluminum and when it was produced.

In addition to eddy current data, surface analysis can be carried out using twist tests. The cast aluminum rod is subjected to a controlled torsion test. Defects associated with improper solidification, inclusions and longitudinal defects created during the rolling process are magnified and revealed on the twisted rod. Generally, these defects manifest in the form of a seam that is parallel to the rolling the direction. A series of parallel lines after the rod is twisted clockwise and counterclockwise indicates that the sample is homogeneous, while non-homogeneities in the casting process will result in fluctuating lines. The results of the twist tests can be recorded in the SCADA system and tracked to the lot of aluminum and when it was produced.

Sample Analysis

The samples discussed below were made with the CCR system noted above. The casting and rolling process which produced the samples started as a continuous stream of molten aluminum from a system of melting and holding furnaces, delivered through a refractory lined launder system to either an in-line chemical grain refining system or the ultrasonic grain refinement system discussed above. Additionally, the CCR system included the ultrasonic degassing system discussed above which uses ultrasonic acoustic waves and a purge gas in order to remove dissolved hydrogen or other gases from the molten aluminum. From the degasser, the metal flowed to a molten metal filter with porous ceramic elements which further reduce inclusions in the molten metal. The launder system then transports the molten aluminum to the tundish. From the tundish, the molten aluminum was poured into a mold formed by the peripheral groove of a copper casting ring and a steel band, as discussed above. Molten aluminum was cooled to a solid cast bar by water distributed through spray nozzles from multi-zone water manifolds with magnetic flow meters for critical zones. The continuous aluminum cast bar exited the casting ring onto a bar extraction conveyor to a rolling mill.

The rolling mill included individually driven rolling stands that reduce the diameter of the bar. The rod was then sent to a drawing mill where the rods were drawn to predetermined diameters, and then coiled. Once the rod was coiled at the end of the process the bulk mechanical and electrical properties of cast aluminum were measured. The quality tests include: tensile, elongation, and conductivity. The Tensile strength is a measure of the strength of the materials and is the maximum force the material can withstand under tension before breaking. The elongation values are a measure of the ductility of the material. Conductivity measurements are generally reported as a percentage of the "international annealed copper standard" (IACS).

1) The Tensile strength is a measure of the strength of the materials and is the maximum force the material can withstand under tension before breaking. The tensile and elongation measurements were carried out on the same sample. A 10" gage length sample was selected for tensile and elongation measurements. The rod sample was inserted into the tensile machine. The grips were placed at 10" gauge marks. Tensile Strength=Breaking Force (pounds)/Cross sectional area ($\pi r^2$) where r (inches) is the radius of the rod.

2) % Elongation=$((L_1-L_2)/L_1)\times 100$. $L_1$ is the initial gage length of the material and $L_2$ is the final length that is obtained by placing the two broken samples from the tension test together and measuring the failure that occurs. Generally, the more ductile the material the more neck down will be observed in the sample in tension.

3) Conductivity: Conductivity measurements are generally reported as a percentage of the "international annealed copper standard" (IACS). Conductivity measurements are carried out using Kelvin Bridge and details are provided in ASTM B193-02. IACS is a unit of electrical conductivity for metals and alloys relative to a standard annealed copper conductor; an IACS value of 100% refers to a conductivity of 5.80×107 siemens per meter (58.0 MS/m) at 20° C.

The continuous rod process as described above was used to produce not only electrical grade aluminum conductors, but also can be used for mechanical aluminum alloys utilizing the ultrasonic grain refining and ultrasonic degassing. For testing the ultrasonic grain refining process, cast bar samples were collected and etched.

A comparative analysis was completed on the rod properties between a rod that was cast using ultrasonic grain refining process and a rod cast using conventional TIBOR grain refiners. Table 1 shows the results of rod processed using the ultrasonic grain refiner vs. results of rod processed using TIBOR grain refiners.

Table 1: Quality Tests: ultrasonic grain refining vs. chemical grain refining[1]

[1] a: 1000 lbs. per sq. in; b: Percentage of Elongation; c: Reported as % IACS; d: Average of 13 rod coils

TABLE 1

| Quality Tests: ultrasonic grain refining vs. chemical grain refining[1] | | | |
|---|---|---|---|
| Ultrasonic Grain Refining Process | | | |
| Tests Conducted | Data Ranges | Average[d] | Standard Deviation |
| Tensile[a] (KSI) | 16.6-18.6 | 17.76 | 0.81 |
| Elongation[b] | 5-8 | 6 | 1.36 |
| Conductivity[c] | 61.7-61.9 | 61.76 | 0.09 |
| Chemical Grain Refiner (TiBor) additions | | | |
| Tests Conducted | Ranges | Average[d] | Standard Deviation |
| Tensile[a] (KSI) | 18-18.7 | 18.29 | 0.29 |
| Elongation[b] | 5-7 | 6.23 | 0.53 |
| Conductivity[c] | 61.5-61.7 | 61.67 | 0.08 |

[1a]1000 lbs. per sq. in; [b]Percentage of Elongation; [c]Reported as % IACS; [d]Average of 13 rod coils Defects associated with improper solidification, inclusions and longitudinal defects created during the rolling process were magnified and revealed on the twisted rod. Generally these defects manifest in the form of a seam that is parallel to the rolling the direction. A series of parallel lines after the rod is twisted clockwise and counterclockwise indicates that the sample is homogeneous while non-homogeneities in the casting process will result in fluctuating lines.

The data in Table 2 below indicated that very few flaws were produced using ultrasonics. While no definitive conclusions have been reached, at least from this set of data points, it appears that the number of surface defects observed by an eddy current tester was lower for the material processed using ultrasonics.

TABLE 2

| Flaw Analysis: ultrasonic grain refining vs. chemical grain refining | | | |
|---|---|---|---|
| Size of Flaw: | Ranges | Average | Standard Deviation |
| Ultrasonic Grain Refining Process | | | |
| Large | 0-0 | 0 | 0 |
| Medium | 0-3 | 0.23 | 0.80 |
| Small | 0-6 | 2.15 | 1.87 |
| Chemical Grain Refiner (TiBor) Additions | | | |
| Large | 1-8 | 1.46 | 2.44 |
| Medium | 0-17 | 3.62 | 4.43 |
| Small | 0-22 | 6.92 | 6.75 |

The twist test results indicated that the surface quality of the ultrasonic grain refined rod was as good as the surface quality of rod produced using chemical grain refiners. After the ultrasonic grain refiner was installed on the continuous rod (CR) process, the chemical grain refiner was reduced to zero while producing high quality cast bar. The hot rolled rod was then drawn down to various wire sizes ranging from 0.1052" to 0.1878". The wires were then processed into overhead transmission cables.

There are two separate conductors that the product could be used for: aluminum conductor steel supported (ACSS) or aluminum conductor steel reinforced (ACSR). One difference between the two processes of making the conductors is that the ACSS aluminum wire is annealed after stranding.

Figure 10:
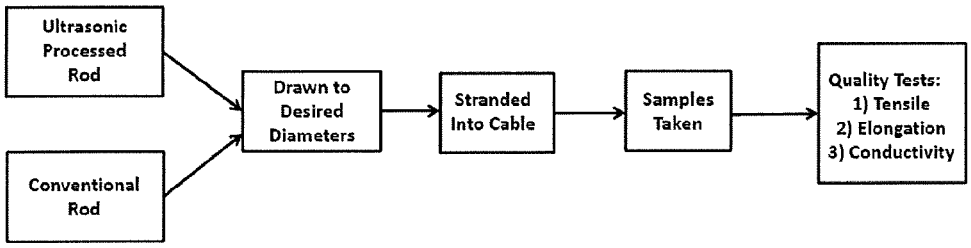
FIG. 10 is an ACSR wire process flow diagram.

FIG. 10 is an ACSR wire process flow diagram. It shows the conversion of pure molten aluminum into aluminum wire that will be used in ACSR wire. The first step in the conversion process is to convert the molten aluminum into aluminum rod. In the next step the rod is drawn through several dies and depending on the end diameter this may be accomplished through one or multiple draws. Once the rod is drawn to final diameters the wire is spooled onto reels of weights ranging between 200 and 500 lbs. These individual reels are stranded around a steel stranded cable into ACSR cables that contains several individual aluminum strands. The number of strands and the diameter of each strand will depend on the customer requirements.

Figure 11:
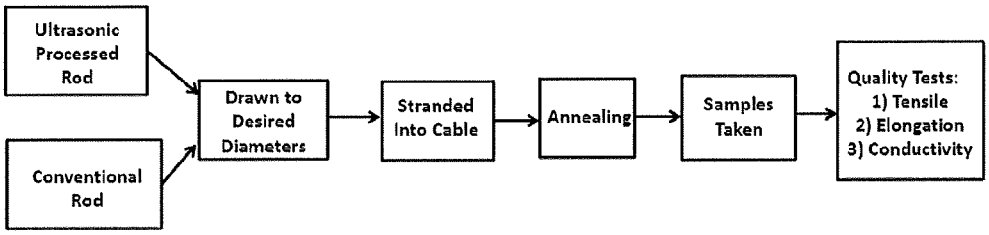
FIG. 11 is an ACSS wire process flow diagram.

FIG. 11 is an ACSS wire process flow diagram. It shows the conversion of pure molten aluminum into aluminum wire that will be used in ACSS wire. The first step in the conversion process is to process the molten aluminum into aluminum rod. In the next step, the rod is drawn through several dies and depending on the end diameter this may be accomplished through one or multiple draws. Once the rod is drawn to final diameters the wire is spooled onto reels of weights ranging between 200 and 500 lbs. These individual reels are stranded around a steel stranded cable into ACSS cables that contains several individual aluminum strands. The number of strands and the diameter of each strand will depend on the customer requirements. One difference between the ACSR and ACSS cable is that, once the aluminum is stranded around the steel cable, the whole cable is heat treated in furnaces to bring the aluminum to a dead soft condition. It is important to note that in ACSR the strength of the cable is derived from the combination of the strengths due to the aluminum and steel cable while in the ACSS cable most of the strength comes from the steel inside the ACSS cable.

Figure 12:
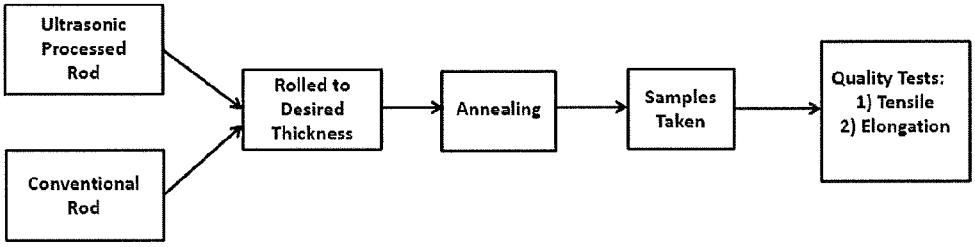
FIG. 12 is an aluminum strip process flow diagram.

FIG. 12 is an aluminum strip process flow diagram, where the strip is finally processed into metal clad cable. It shows that the first step is to convert the molten aluminum into aluminum rod. Following this the rod is rolled through several rolling dies to convert it into strip, generally of about 0.375" in width and about 0.015 to 0.018" thickness. The rolled strip is processed into donut shaped pads that weigh approximately 600 lbs. It is important to note that other widths and thicknesses can also be produced using the rolling process, but the 0.375" width and 0.015 to 0.018" thickness are the most common. These pads are then heat treated in furnaces to bring the pads to an intermediate anneal condition. In this condition, the aluminum is neither fully hard or in a dead soft condition. The strip is then used as a protective jacket assembled as an armor of interlocking metal tape (strip) that encloses one or more insulated circuit conductors.

The comparative analysis shown below based on these processes was completed on aluminum drawn wire that was processed with the ultrasonic grain refining process and aluminum wire that was processed using conventional TIBOR grain refiners. All specifications as outlined in the ASTM standards for 1350 electrical conductor wire were met on the drawn samples.

Properties of Conventional Rod Including TIBOR Chemical Grain Refiners

| | Tensile[A] KSI | Tensile[B] Mpa | Elongation[C] | IACS %[D] |
|---|---|---|---|---|
| 1350* EC Rod .375" Diameter | | | | |
| AVERAGE | 14.41 | 99.2849 | 20.2 | 61.98 |
| STD Dev | 0.364554523 | 2.511780661 | 1.805547009 | 0.09798 |
| Min | 13.6 | 93.704 | 17 | 61.8 |
| Max | 14.9 | 102.661 | 25 | 62.1 |
| 8176* EEE Rod .375" Diameter | | | | |
| AVERAGE | 17.875 | 123.15875 | 17.05 | 59.79 |
| STD Dev | 0.719635324 | 4.958287385 | 0.217944947 | 0.099499 |
| Min | 16.2 | 111.618 | 17 | 59.7 |
| Max | 18.9 | 130.221 | 18 | 59.9 |
| 5154* Rod .375" Diameter | | | | |
| AVERAGE | 32.915 | 226.78435 | 18.75 | N/A |
| STD Dev | 0.358154994 | 2.467687911 | 0.698212002 | N/A |
| Min | 32.1 | 221.169 | 18 | N/A |
| Max | 33.5 | 230.815 | 20 | N/A |
| 5356* Rod .375" Diameter | | | | |
| AVERAGE | 43.97 | 302.9533 | 18.5 | N/A |
| STD Dev | 0.613269924 | 4.225429778 | 0.5 | N/A |
| Min | 43.4 | 299.026 | 18 | N/A |
| Max | 45.2 | 311.428 | 19 | N/A |

Properties-of Ultrasonic Processed Rod

| | Tensile[A] KSI | Tensile[B] Mpa | Elongation[C] | IACS %[D] |
|---|---|---|---|---|
| 1350* EC Rod .375" Diameter | | | | |
| AVERAGE | 13.93 | 95.9777 | 21.1 | 62.17 |
| STD Dev | 0.401372645 | 2.765457523 | 2.3 | 0.130767 |
| Min | 13.2 | 90.948 | 17 | 62 |
| Max | 14.5 | 99.905 | 25 | 62.3 |
| 8176* EEE Rod .375" Diameter | | | | |
| AVERAGE | 16.63 | 114.5807 | 19.35 | 60.86 |
| STD Dev | 0.815536633 | 5.619047402 | 1.38834434 | 0.04899 |
| Min | 15.1 | 104.039 | 17 | 60.8 |
| Max | 18.5 | 127.465 | 23 | 60.9 |
| 5154* Rod .375" Diameter | | | | |
| AVERAGE | 33.97 | 234.0533 | 18.9 | N/A |
| STD Dev | 0.491019348 | 3.383123307 | 0.99498744 | N/A |
| Min | 33.2 | 228.748 | 18 | N/A |
| Max | 34.7 | 239.083 | 22 | N/A |
| 5356* Rod .375" Diameter | | | | |
| AVERAGE | 41.5 | 285.935 | 19.2 | N/A |
| STD Dev | 0.761577311 | 5.24726767 | 0.87177979 | N/A |
| Min | 40.1 | 276.289 | 18 | N/A |
| Max | 42.6 | 293.514 | 20 | N/A |

Processing Conditions for Ultrasonic Processed Rods

| Alloy Designation | Casting Rate | Ultrasonic Degassing Amplitude | Ultrasonic Degassing Frequency | Ultrasonic Grain Refining Amplitude | Ultrasonic Grain Refining Frequency |
|---|---|---|---|---|---|
| 1350 (EC) | 15 tons per hour | 60% | 20 KHz | 80% | 20 KHz |
| 8176 (EEE) | 15 tons per hour | 60% | 20 KHz | 80% | 20 KHz |
| 5154 | 4 tons per hour | 60% | 20 KHz | 80% | 20 KHz |
| 5356 | 4 tons per hour | 60% | 20 KHz | 80% | 20 KHz |

*Alloy designations are per Aluminum Association Specifications
**Aluminum Conductor Steel Supported
***Aluminum Conductor Steel Reinforced
A. 1000 lbs. per square inch
B. Tensile strength in mega pascals
C. Percentage Elongation
D. International Annealed Copper Standard
*All length dimensions are in inches.

Figure 15:
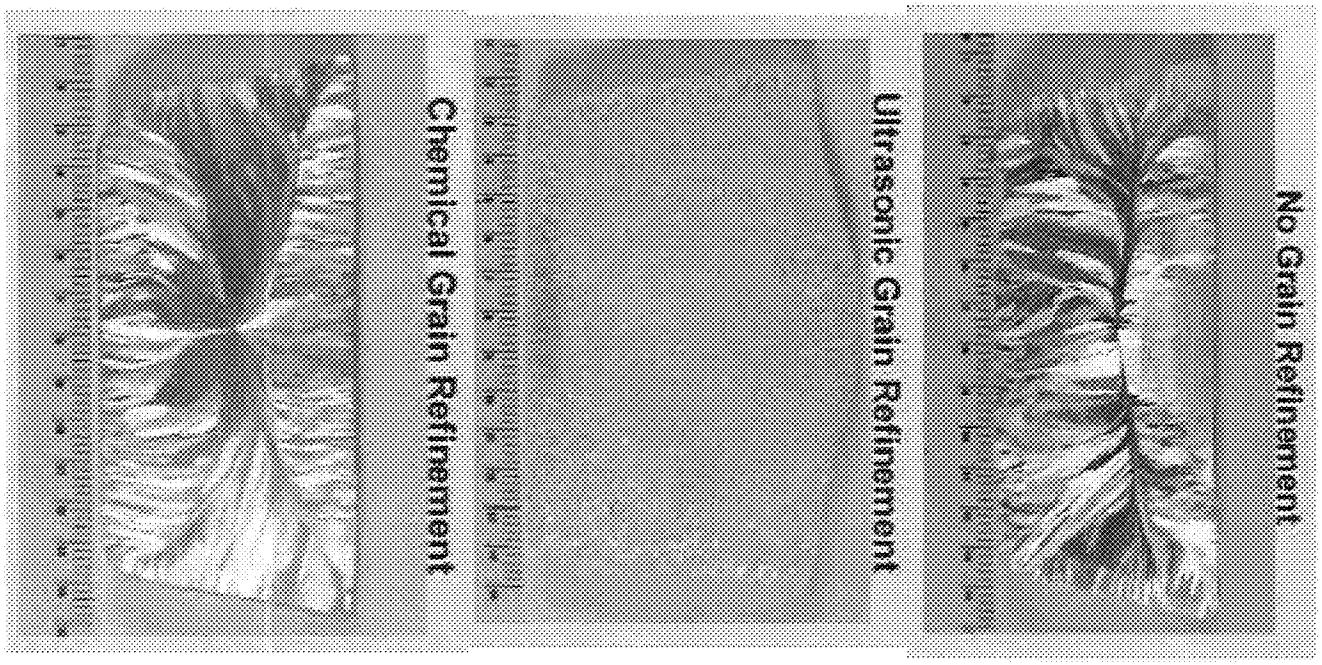
FIG. 15 is a micrographic comparison of an aluminum 1350 EC alloy showing the grain structure of castings with no chemical grain refiners, with grain refiners, and with only ultrasonic grain refining.

FIG. 15 is a micrographic comparison of an aluminum 1350 EC alloy showing the grain structure of castings with no chemical grain refiners, with grain refiners, and with only ultrasonic grain refining.

FIG. 16 is tabular comparison of a conventional 1350 EC aluminum alloy rod (with chemical grain refiners) to a 1350 EC aluminum alloy rod (with ultrasonic grain refinement).

FIG. 17 is tabular comparison of a conventional ACSR aluminum Wire 0.130" Diameter (with chemical grain refiners) to ACSR aluminum Wire 0.130" Diameter (with ultrasonic grain refinement).

FIG. 18 is tabular comparison of a conventional 8176 EEE aluminum alloy rod (with chemical grain refiners) to an 8176 EEE aluminum alloy rod (with ultrasonic grain refinement).

FIG. 19 is tabular comparison of a conventional 5154 aluminum alloy rod (with chemical grain refiners) to a 5154 aluminum alloy rod (with ultrasonic grain refinement).

FIG. 20 is tabular comparison of a conventional 5154 aluminum alloy strip (with chemical grain refiners) to a 5154 aluminum alloy strip (with ultrasonic grain refinement).

FIG. 21 is tabular depiction of the properties of a 5356 aluminum alloy rod (with ultrasonic grain refinement).

Generalized Statements of the Invention

The following statements of the invention provide one or more characterizations of the present invention and do not limit the scope of the present invention.

Statement 1. A molten metal processing device for a casting wheel on a casting mill, comprising: an assembly mounted on (or coupled to) the casting wheel, including at least one vibrational energy source which supplies (e.g., which has a configuration which supplies) vibrational energy (e.g., ultrasonic, mechanically-driven, and/or acoustic energy supplied directly or indirectly) to molten metal cast in the casting wheel while the molten metal in the casting wheel is cooled, a support device holding the at least one vibrational energy source, and optionally a guide device which guides the assembly with respect to movement of the casting wheel.

Statement 2. The device of statement 1, wherein the support device includes a housing comprising a cooling channel for transport of a cooling medium therethrough.

Statement 3. The device of statement 2, wherein the cooling channel includes said cooling medium comprising at least one of water, gas, liquid metal, and engine oils.

Statement 4. The device of statement 1, 2, 3, or 4. wherein the at least one vibrational energy source comprises at least one ultrasonic transducer, at least one mechanically-driven vibrator, or a combination thereof.

Statement 5. The device of statement 4, wherein the ultrasonic transducer (e.g., a piezoelectric element) is configured to provide vibrational energy in a range of frequencies up to 400 kHz or wherein the ultrasonic transducer (e.g., a magnetostrictive element) is configured to provide vibrational energy in a range of frequencies 20 to 200 kHz. Statement 6. The device of statement 1, 2, or 3, wherein the mechanically-driven vibrator comprises a plurality of mechanically-driven vibrators. Statement 7. The device of statement 4, wherein the mechanically-driven vibrator is configured to provide vibrational energy in a range of frequencies up to 10 KHz, or wherein the mechanically-driven vibrator is configured to provide vibrational energy in a range of frequencies from 8,000 to 15,000 vibrations per minute.

Statement 8a. The device of statement 1, wherein the casting wheel includes a band confining the molten metal in a channel of the casting wheel. Statement 8b. The device of any one of statements 1-7, wherein the assembly is positioned above the casting wheel and has passages in a housing for a band confining the molten metal in the channel of the casting wheel to pass therethrough. Statement 9. The device of statement 8, wherein said band is guided along the housing to permit the cooling medium from the cooling channel to flow along a side of the band opposite the molten metal.

Statement 10. The device of any one of statements 1-9, wherein the support device comprises at least one or more of niobium, a niobium alloy, titanium, a titanium alloy, tantalum, a tantalum alloy, copper, a copper alloy, rhenium, a rhenium alloy, steel, molybdenum, a molybdenum alloy, stainless steel, a ceramic, a composite, a polymer, or a metal. Statement 11. The device of statement 10, wherein the ceramic comprises a silicon nitride ceramic. Statement 12. The device of statement 11, wherein the silicon nitride ceramic comprises a SIALON.

Statement 13. The device of any one of statements 1-12, wherein the housing comprises a refractory material. Statement 14. The device of statement 13, wherein the refractory material comprises at least one of copper, niobium, niobium and molybdenum, tantalum, tungsten, and rhenium, and alloys thereof. Statement 15. The device of statement 14, wherein the refractory material comprises one or more of silicon, oxygen, or nitrogen.

Statement 16. The device of any one of statements 1-15, wherein the at least one vibrational energy source comprises more than one vibrational energy sources in contact with a cooling medium; e.g., in contact with a cooling medium flowing through the support device or the guide device. Statement 17. The device of statement 16, wherein the at least one vibrational energy source comprises at least one vibrating probe inserted into a cooling channel in the support device. Statement 18. The device of any one of statements 1-3 and 6-15, wherein the at least one vibrational energy source comprises at least one vibrating probe in contact with the support device. Statement 19. The device of any one of statements 1-3 and 6-15, wherein the at least one vibrational energy source comprises at least one vibrating probe in contact with a band at a base of the support device. Statement 20. The device of any one of statements 1-19, wherein the at least one vibrational energy source comprises plural vibrational energy sources distributed at different positions in the support device.

Statement 21. The device of any one of statements 1-20, wherein the guide device is disposed on a band on a rim of the casting wheel.

Statement 22. A method for forming a metal product, comprising:

providing molten metal into a containment structure of a casting mill;

cooling the molten metal in the containment structure, and coupling vibrational energy into the molten metal in the containment structure during said cooling.

Statement 23. The method of statement 22, wherein providing molten metal comprises pouring molten metal into a channel in a casting wheel.

Statement 24. The method of statements 22 or 23, wherein coupling vibrational energy comprises supplying said vibrational energy from at least one of an ultrasonic transducer or a magnetostrictive transducer. Statement 25. The method of statement 24, wherein supplying said vibrational energy comprises providing the vibrational energy in a range of frequencies from 5 and 40 kHz. Statement 26. The method of statements 22 or 23, wherein coupling vibrational energy comprises supplying said vibrational energy from a mechanically-driven vibrator. Statement 27. The method of statement 26, wherein supplying said vibrational energy comprises providing the vibrational energy n a range of frequencies from 8,000 to 15,000 vibrations per minute or up to 10 KHz.

Statement 28. The method of any one of statements 22-27, wherein cooling comprises cooling the molten metal by application of at least one of water, gas, liquid metal, and engine oil to a confinement structure holding the molten metal.

Statement 29. The method of any one of statements 22-28, wherein providing molten metal comprises delivering said molten metal into a mold. Statement 30. The method of any one of statements 22-29, wherein providing molten metal comprises delivering said molten metal into a continuous casting mold. Statement 31. The method of any one of statements 22-30, wherein providing molten metal comprises delivering said molten metal into a horizontal or vertical casting mold.

Statement 32. A casting mill comprising a casting mold configured to cool molten metal, and the molten metal processing device of any one of statements 1-21. Statement 33. The mill of statement 32, wherein the mold comprises a continuous casting mold. Statement 34. The mill of statements 32 or 33, wherein the mold comprises a horizontal or vertical casting mold.

Statement 35. A casting mill comprising: a molten metal containment structure configured to cool molten metal; and a vibrational energy source attached to the molten metal containment and configured to couple vibrational energy into the molten metal at frequencies ranging up to 400 kHz.

Statement 36. A casting mill comprising: a molten metal containment structure configured to cool molten metal; and a mechanically-driven vibrational energy source attached to the molten metal containment and configured to couple vibrational energy at frequencies ranging up to 10 KHz (including a range from 0 to 15,000 vibrations per minute and 8,000 to 15,000 vibrations per minute) into the molten metal.

Statement 37. A system for forming a metal product, comprising: means for pouring molten metal into a molten metal containment structure; means for cooling the molten metal containment structure; means for coupling vibration energy into the molten metal at frequencies ranging up to 400 KHz (including ranges from 0 to 15,000 vibrations per minute, 8,000 to 15,000 vibrations per minute, up to 10 KHz, 15 to 40 KHz, or 20 to 200 kHz); and a controller including data inputs and control outputs, and programmed with control algorithms which permit operation of any one of the step elements recited in statements 22-31.

Statement 38. A system for forming a metal product, comprising: the molten metal processing device of any one of the statements 1-21; and a controller including data inputs and control outputs, and programmed with control algorithms which permit operation of any one of the step elements recited in statements 22-31.

Statement 39. A system for forming a metal product, comprising: an assembly coupled to the casting wheel, including a housing holding a cooling medium such that molten metal cast in the casting wheel is cooled by the cooling medium and a device which guides the assembly with respect to movement of the casting wheel.

Statement 40. The system of statement 38 including any of the elements defined in statements 2-3, 8-15, and 21.

Statement 41. A molten metal processing device for a casting mill, comprising: at least one vibrational energy source which supplies vibrational energy into molten metal cast in the casting wheel while the molten metal in the casting wheel is cooled; and a support device holding said vibrational energy source.

Statement 42. The device of statement 41 including any of the elements defined in statements 4-15.

Statement 43. A molten metal processing device for a casting wheel on a casting mill, comprising: an assembly coupled to the casting wheel, including 1) at least one vibrational energy source which supplies vibrational energy to molten metal cast in the casting wheel while the molten metal in the casting wheel is cooled, 2) a support device holding said at least one vibrational energy source, and 3) an optional guide device which guides the assembly with respect to movement of the casting wheel.

Statement 44. The device of statement 43, wherein the at least one vibrational energy source supplies the vibrational energy directly into the molten metal cast in the casting wheel.

Statement 45. The device of statement 43, wherein the at least one vibrational energy source supplies the vibrational energy indirectly into the molten metal cast in the casting wheel.

Statement 46. A molten metal processing device for a casting mill, comprising: at least one vibrational energy source which supplies vibrational energy by a probe inserted into molten metal cast in the casting wheel while the molten metal in the casting wheel is cooled; and a support device holding said vibrational energy source, wherein the vibrational energy reduces molten metal segregation as the metal solidifies.

Statement 47. The device of statement 46, including any of the elements defined in statements 2-21.

Statement 48. A molten metal processing device for a casting mill, comprising: at least one vibrational energy source which supplies acoustic energy into molten metal cast in the casting wheel while the molten metal in the casting wheel is cooled; and a support device holding said vibrational energy source.

Statement 49. The device of statement 48, wherein the at least one vibrational energy source comprises an audio amplifier.

Statement 50. The device of statement 49, wherein the audio amplifier couples vibrational energy through a gaseous medium into the molten metal.

Statement 51. The device of statement 49, wherein the audio amplifier couples vibrational energy through a gaseous medium into a support structure holding the molten metal.

Statement 52. A method for refining grain size, comprising: supplying vibrational energy to a molten metal while the molten metal is cooled; breaking apart dendrites formed in the molten metal to generate a source of nuclei in the molten metal.

Statement 53. The method of statement 52, wherein the vibrational energy comprises at least one or more of ultrasonic vibrations, mechanically-driven vibrations, and acoustic vibrations.

Statement 54. The method of statement 52, wherein the source of nuclei in the molten metal does not include foreign impurities.

Statement 55. The method of statement 52, wherein a portion of the molten metal is undercooled to produce said dendrites.

Statement 56. A molten metal processing device comprising:

a source of molten metal;

an ultrasonic degasser including an ultrasonic probe inserted into the molten metal;

a casting for reception of the molten metal;

an assembly mounted on the casting, including, at least one vibrational energy source which supplies vibrational energy to molten metal cast in the casting while the molten metal in the casting-is cooled, and a support device holding said at least one vibrational energy source.

Statement 57. The device of statement 56, wherein the casting comprises a component of a casting wheel of a casting mill.

Statement 58. The device of statement 56, wherein the support device includes a housing comprising a cooling channel for transport of a cooling medium therethrough.

Statement 59. The device of statement 58, wherein the cooling channel includes said cooling medium comprising at least one of water, gas, liquid metal, and engine oils.

Statement 60. The device of statement 56, wherein the at least one vibrational energy source comprises an ultrasonic transducer.

Statement 61. The device of statement 56, wherein the at least one vibrational energy source comprises a mechanically-driven vibrator.

Statement 62. The device of statement 61, wherein the mechanically-driven vibrator is configured to provide vibrational energy in a range of frequencies from up to 10 KHz.

Statement 63. The device of statement 56, wherein the casting includes a band confining the molten metal in a channel of a casting wheel.

Statement 64. The device of statement 63, wherein the assembly is positioned above the casting wheel and has passages in a housing for a band confining the molten metal in a channel of the casting wheel to pass therethrough.

Statement 65. The device of statement 64, wherein said band is guided along the housing to permit the cooling medium from the cooling channel to flow along a side of the band opposite the molten metal.

Statement 66. The device of statement 56, wherein the support device comprises at least one or more of niobium, a niobium alloy, titanium, a titanium alloy, tantalum, a tantalum alloy, copper, a copper alloy, rhenium, a rhenium alloy, steel, molybdenum, a molybdenum alloy, stainless steel, a ceramic, a composite, a polymer, or a metal.

Statement 67. The device of statement 66, wherein the ceramic comprises a silicon nitride ceramic.

Statement 68. The device of statement 67, wherein the silicon nitride ceramic comprises a SIALON.

Statement 69. The device of statement 64, wherein the housing comprises a refractory material.

Statement 70. The device of statement 69, wherein the refractory material comprises at least one of copper, niobium, niobium and molybdenum, tantalum, tungsten, and rhenium, and alloys thereof.

Statement 71. The device of statement 69, wherein the refractory material comprises one or more of silicon, oxygen, or nitrogen.

Statement 72. The device of statement 56, wherein the at least one vibrational energy source comprises more than one vibrational energy sources in contact with a cooling medium.

Statement 73. The device of statement 72, wherein the at least one vibrational energy source comprises at least one vibrating probe inserted into a cooling channel in the support device.

Statement 74. The device of statement 56, wherein the at least one vibrational energy source comprises at least one vibrating probe in contact with the support device.

Statement 75. The device of statement 56, wherein the at least one vibrational energy source comprises at least one vibrating probe in direct contact with a band at a base of the support device.

Statement 76. The device of statement 56, wherein the at least one vibrational energy source comprises plural vibrational energy sources distributed at different positions in the support device.

Statement 77. The device of statement 57, further comprising a guide device which guides the assembly with respect to movement of the casting wheel.

Statement 78. The device of statement 72, wherein the guide device is disposed on a band on a rim of the casting wheel.

Statement 79. The device of statement 56, wherein the ultrasonic degasser comprises:

an elongated probe comprising a first end and a second end, the first end attached to the ultrasonic transducer and the second end comprising a tip, and a purging gas delivery comprising a purging gas inlet and a purging gas outlet, said purging gas outlet disposed at the tip of the elongated probe for introducing a purging gas into the molten metal.

Statement 80. The device of statement 56, wherein the elongated probe comprises a ceramic.

Statement 81. A metallic product comprising:

a cast metallic composition having sub-millimeter grain sizes and including less than 0.5% grain refiners therein and having at least one of the following properties:

an elongation which ranges from 10 to 30% under a stretching force of 100 lbs/in$^2$, a tensile strength which ranges from 50 to 300 MPa; or an electrical conductivity which ranges from 45 to 75% of IAC, where IAC is a percent unit of electrical conductivity relative to a standard annealed copper conductor.

Statement 82. The product of statement 81, wherein the composition includes less than 0.2% grain refiners therein.

Statement 83. The product of statement 81, wherein the composition includes less than 0.1% grain refiners therein.

Statement 84. The product of statement 81, wherein the composition includes no grain refiners therein.

Statement 85. The product of statement 81, wherein the composition includes at least one of aluminum, copper, magnesium, zinc, lead, gold, silver, tin, bronze, brass, and alloys thereof.

Statement 86. The product of statement 81, wherein the composition is formed into at least one of a bar stock, a rod, stock, a sheet stock, wires, billets, and pellets.

Statement 87. The product of statement 81, wherein the elongation ranges from 15 to 25%, or the tensile strength ranges from 100 to 200 MPa, or the electrical conductivity which ranges from 50 to 70% of IAC.

Statement 88. The product of statement 81, wherein the elongation ranges from 17 to 20%, or the tensile strength ranges from 150 to 175 MPa, or the electrical conductivity which ranges from 55 to 65% of IAC.

Statement 89. The product of statement 81, wherein the elongation ranges from 18 to 19%, or the tensile strength ranges from 160 to 165 MPa, or the electrical conductivity which ranges from 60 to 62% of IAC.

Statement 90. The product of any one of statements 81, 87, 88, and 89, wherein the composition comprises aluminum or an aluminum alloy.

Statement 91. The product of statement 90, wherein the aluminum or the aluminum alloy comprises a steel reinforced wire strand.

Statement 92. The product of statement 90, wherein the aluminum or the aluminum alloy comprises a steel supported wire strand.

Statement 92. A metallic product made by any one or more of the process steps set forth in statements 52-55, and comprising a cast metallic composition.

Statement 93. The product of statement 92, wherein the cast metallic composition has sub-millimeter grain sizes and includes less than 0.5% grain refiners therein.

Statement 94. The product of statement 92, wherein the metallic product has at least one of the following properties:

an elongation which ranges from 10 to 30% under a stretching force of 100 lbs/in$^2$, a tensile strength which ranges from 50 to 300 MPa; or an electrical conductivity which ranges from 45 to 75% of IAC, where IAC is a percent unit of electrical conductivity relative to a standard annealed copper conductor.

Statement 95. The product of statement 92, wherein the composition includes less than 0.2% grain refiners therein.

Statement 96. The product of statement 92, wherein the composition includes less than 0.1% grain refiners therein.

Statement 97. The product of statement 92, wherein the composition includes no grain refiners therein.

Statement 98. The product of statement 92, wherein the composition includes at least one of aluminum, copper, magnesium, zinc, lead, gold, silver, tin, bronze, brass, and alloys thereof.

Statement 99. The product of statement 92, wherein the composition is formed into at least one of a bar stock, a rod, stock, a sheet stock, wires, billets, and pellets.

Statement 100. The product of statement 92, wherein the elongation ranges from 15 to 25%, or the tensile strength ranges from 100 to 200 MPa, or the electrical conductivity which ranges from 50 to 70% of IAC.

Statement 101. The product of statement 92, wherein the elongation ranges from 17 to 20%, or the tensile strength ranges from 150 to 175 MPa, or the electrical conductivity which ranges from 55 to 65% of IAC.

Statement 102. The product of statement 92, wherein the elongation ranges from 18 to 19%, or the tensile strength ranges from 160 to 165 MPa, or the electrical conductivity which ranges from 60 to 62% of IAC.

Statement 103. The product of statement 92, wherein the composition comprises aluminum or an aluminum alloy.

Statement 104. The product of statement 103, wherein the aluminum or the aluminum alloy comprises a steel reinforced wire strand.

Statement 105. The product of statement 103, wherein the aluminum or the aluminum alloy comprises a steel supported wire strand.

Numerous modifications and variations of the present invention are possible in light of the above teachings. It is therefore to be understood that within the scope of the appended claims, the invention may be practiced otherwise than as specifically described herein.

The invention claimed is:

1. A molten metal processing device for a casting wheel on a casting mill, the casting wheel including a containment structure for receiving and casting molten metal and a band enclosing a portion of the containment structure in which the molten metal is cast, the band extending around a portion of a perimeter of the casting wheel, comprising:

an assembly mounted on an outer surface of the casting wheel band, including, at least one vibrational energy source which supplies vibrational energy to molten metal cast in the casting wheel, and a support device holding said at least one vibrational energy source, wherein the vibrational energy is supplied from the vibrational energy source to the molten metal cast through an intervening liquid medium in contact with the casting wheel band.

2. The device of claim 1, wherein the support device includes a housing comprising a cooling channel for transport of a cooling medium therethrough.

3. The device of claim 2, wherein the cooling channel includes said cooling medium comprising at least one of water, gas, liquid metal, and engine oils.

4. The device of claim 1, wherein the at least one vibrational energy source comprises at least one ultrasonic transducer, at least one mechanically-driven vibrator, or a combination thereof.

5. The device of claim 4, wherein the ultrasonic transducer is configured to provide vibrational energy in a range of frequencies up to 400 kHz.

6. The device of claim 4, wherein the mechanically-driven vibrator comprises a plurality of mechanically-driven vibrators.

7. The device of claim 4, wherein the mechanically-driven vibrator is configured to provide vibrational energy in a range of frequencies up to 10 KHz.

8. The device of claim 1, wherein the assembly is positioned above the casting wheel and has passages in a housing for the band confining the molten metal in a channel of the casting wheel to pass therethrough.

9. The device of claim 8, wherein the housing has a cooling channel for transport of a cooling medium therethrough, and said band is guided along the housing to permit the cooling medium from the cooling channel to flow along a side of the band opposite the molten metal.

10. The device of claim 1, wherein the support device comprises at least one or more of niobium, a niobium alloy, titanium, a titanium alloy, tantalum, a tantalum alloy, copper, a copper alloy, rhenium, a rhenium alloy, steel, molybdenum, a molybdenum alloy, stainless steel, a ceramic, a composite, a polymer, or a metal.

11. The device of claim 10, wherein the ceramic comprises a silicon nitride ceramic.

12. The device of claim 11, wherein the silicon nitride ceramic comprises a silica alumina nitride.

13. The device of claim 1, wherein the support device includes a housing comprising a cooling channel for transport of a cooling medium therethrough, and the housing comprises a refractory material.

14. The device of claim 13, wherein the refractory material comprises at least one of copper, niobium, niobium and molybdenum, tantalum, tungsten, and rhenium, and alloys thereof.

15. The device of claim 14, wherein the refractory material comprises one or more of silicon, oxygen, or nitrogen.

16. The device of claim 1, wherein the at least one vibrational energy source comprises more than one vibrational energy sources in contact with a cooling medium.

17. The device of claim 16, wherein the at least one vibrational energy source comprises at least one vibrating probe inserted into a cooling channel in the support device.

18. The device of claim 1, wherein the at least one vibrational energy source comprises at least one vibrating probe in contact with the support device.

19. The device of claim 1, wherein the at least one vibrational energy source comprises at least one vibrating probe in direct contact with the band at a base of the support device.

20. The device of claim 1, wherein the at least one vibrational energy source comprises plural vibrational energy sources distributed at different positions in the support device.

21. The device of claim 1, further comprising a guide device which guides the assembly with respect to movement of the casting wheel.

22. The device of claim 21, wherein the guide device is disposed on the band on a rim of the casting wheel.

23. A molten metal processing device comprising:

a source of molten metal;

an ultrasonic degasser including an ultrasonic probe inserted into the molten metal;

a casting wheel for reception of the molten metal;

a band extending around a portion of a perimeter of the casting wheel;

an assembly mounted on the band, including, at least one vibrational energy source which supplies vibrational energy through the band to molten metal cast in the casting wheel while the molten metal in the casting wheel is cooled, and a support device holding said at least one vibrational energy source, wherein the vibrational energy is supplied from the vibrational energy source to the molten metal cast through an intervening liquid medium.

24. The device of claim 23, wherein the ultrasonic degasser comprises:

an elongated probe comprising a first end and a second end, the first end attached to the ultrasonic transducer and the second end comprising a tip, and a purging gas delivery comprising a purging gas inlet and a purging gas outlet, said purging gas outlet disposed at the tip of the elongated probe for introducing a purging gas into the molten metal.

25. A molten metal processing device for a casting wheel on a casting mill, comprising:

at least one vibrational energy source mounted in a fixed position on the casting mill and mounted so as to be in contact with a band of the casting wheel through a cooling medium and the vibrational energy source configured to supply vibrational energy to metal cast in the casting wheel while the metal cools and while a rim of the casting wheel rotates past the vibrational energy source, and wherein the vibrational energy is supplied from the vibrational energy source to the metal cast in the casting wheel through the intervening cooling medium.

26. The device of claim 25, further comprising a support device holding the at least one vibrational energy source that includes a housing comprising a cooling channel for transport of the cooling medium therethrough, and wherein the at least one vibrational energy source comprises an ultrasonic transducer.

27. The device of claim 26, wherein the metal comprises aluminum.

28. The device of claim 25, wherein the vibrational energy source is located above the casting wheel.

* * * * *